US010994916B2

(12) United States Patent
Getsay et al.

(10) Patent No.: US 10,994,916 B2
(45) Date of Patent: May 4, 2021

(54) SLEEVE MEMBER, CONTAINER ASSEMBLY KIT INCLUDING SAME, AND ASSOCIATED METHOD OF MANUFACTURING A SLEEVE MEMBER

(71) Applicant: LIQUITEK LLC, Zelienople, PA (US)

(72) Inventors: James G. Getsay, Harmony, PA (US); Paul Terlinski, Pittsburgh, PA (US)

(73) Assignee: LIQUITEK LLC, Zelienople, PA (US)

( * ) Notice: Subject to any disclaimer, the term of this patent is extended or adjusted under 35 U.S.C. 154(b) by 139 days.

(21) Appl. No.: 16/204,376

(22) Filed: Nov. 29, 2018

(65) Prior Publication Data

US 2019/0161267 A1 May 30, 2019

Related U.S. Application Data

(60) Provisional application No. 62/592,981, filed on Nov. 30, 2017.

(51) Int. Cl.
*B65D 81/38* (2006.01)

(52) U.S. Cl.
CPC ..... *B65D 81/3881* (2013.01); *B65D 81/3841* (2013.01); *B65D 81/3879* (2013.01); *B65D 81/3886* (2013.01)

(58) Field of Classification Search
CPC ..... B65D 81/3881; B65D 81/31; B65D 81/3876; B65D 81/3883; B65D 81/3888; B65D 81/3893; B65D 81/3897; B65D 81/3886; B65D 81/3879; B65D 81/3841; B65D 15/00; B65D 15/14; A47G 23/01; A47G 23/0208; A47G 23/0266; A47G 23/0291; A47G 23/0216; A47G 23/0283
See application file for complete search history.

(56) References Cited

U.S. PATENT DOCUMENTS

| | | | |
|---|---|---|---|
| 20,592 | A | 6/1858 | Smith |
| 21,717 | A | 10/1858 | Stimpson |
| 1,016,346 | A | 2/1912 | Markee |
| 1,191,319 | A | 7/1916 | Kline |
| 1,200,748 | A | 10/1916 | Munger |
| 1,269,197 | A | 6/1918 | Mendenhall |

(Continued)

FOREIGN PATENT DOCUMENTS

| | | | |
|---|---|---|---|
| CN | 1837669 | A | 9/2006 |
| GB | 123632 | A | 3/1919 |

OTHER PUBLICATIONS

Known Products.

(Continued)

*Primary Examiner* — Don M Anderson
(74) *Attorney, Agent, or Firm* — Eckert Seamans Cherin & Mellott, LLC

(57) ABSTRACT

A sleeve member includes a bellows member having a top and a bottom located opposite the top, and an inner liner located internal with respect to the bellows member. The inner liner has a top and a bottom located opposite the top of the inner liner. The top and the bottom of the inner liner are connected to the top and the bottom of the bellows member, respectively, such that a vacuum entrapment is provided between the bellows member and the inner liner. A passage is provided through the top and the bottom of the bellows member, and through the top and the bottom of the inner liner.

23 Claims, 31 Drawing Sheets

(56) References Cited

U.S. PATENT DOCUMENTS

| | | | | | |
|---|---|---|---|---|---|
| 1,518,668 | A | | 12/1924 | Mitchell | |
| 1,568,948 | A | | 1/1926 | Robe | |
| 1,910,703 | A | | 5/1933 | Le Grand | |
| RE19,362 | E | | 11/1934 | Justheim | |
| 1,993,730 | A | | 3/1935 | Carpenter | |
| 2,060,155 | A | | 11/1936 | Wilhelm | |
| 2,239,128 | A | | 4/1941 | Sykes | |
| 2,963,188 | A | * | 12/1960 | Palermo | A47J 41/0072 215/12.2 |
| 3,144,160 | A | | 8/1964 | Johnson et al. | |
| 3,149,741 | A | | 9/1964 | Bergan | |
| 3,250,416 | A | | 5/1966 | Clarke | |
| 4,163,374 | A | * | 8/1979 | Moore | F25D 3/08 62/457.4 |
| 5,048,307 | A | * | 9/1991 | Baxter | B65D 81/3881 62/372 |
| 5,769,262 | A | | 6/1998 | Yamada et al. | |
| 8,499,947 | B2 | | 8/2013 | Trost et al. | |
| 8,616,404 | B1 | | 12/2013 | Starck et al. | |
| 9,463,918 | B2 | | 10/2016 | Reid | |
| 2005/0098244 | A1 | | 5/2005 | Okada | |
| 2005/0165468 | A1 | | 7/2005 | Marton | |
| 2009/0130275 | A1 | | 5/2009 | Trost et al. | |
| 2012/0168452 | A1 | * | 7/2012 | Chen | B65D 81/3876 220/737 |
| 2014/0224359 | A1 | | 8/2014 | Youell | |
| 2017/0259983 | A1 | | 9/2017 | Tolman et al. | |

OTHER PUBLICATIONS

International Search Report and Written Opinion dated Apr. 9, 2019, 19 pages.

International Search Report and Written Opinion dated Apr. 24, 2019, 16 pages.

* cited by examiner

SLEEVE MEMBER, CONTAINER ASSEMBLY KIT INCLUDING SAME, AND ASSOCIATED METHOD OF MANUFACTURING A SLEEVE MEMBER

CROSS-REFERENCE TO RELATED APPLICATION

This application claims priority from and claims the benefit of U.S. Provisional Patent Application Ser. No. 62/592,981, filed Nov. 30, 2017, which is incorporated by reference herein.

BACKGROUND

Field

The disclosed concept relates to sleeve members. The disclosed concept also relates to container assembly kits including sleeve members. The disclosed concept further relates to methods of manufacturing sleeve members.

Background Information

When individuals consume beverages, such as, for example, cold beer or hot chocolate, it is often desirable to maintain the beverage at a constant temperature. That is, on a hot day, it is often desirable to maintain beer at as cool a temperature as possible, while on a cold day, it is often desirable to maintain hot chocolate at as hot a temperature as possible. A number of products exist in the industry which attempt to address these needs. These products typically attempt to insulate the beverage. One known method of insulating beverages includes providing for a double walled container. Because thermal heat generally travels better through air than through a vacuum, manufacturers will attempt to create a vacuum between the two walls, in order to provide for an "insulative" body to prevent the flow of heat into and out of the beverage. These containers suffer from a number of drawbacks.

More specifically, while achieving a perfect vacuum is impossible, there is significant room for improvement in the amount of vacuum that can be established between the two walls. Furthermore, attempts to create the vacuum commonly involve the placement of a resin wafer over a hole in one of the walls of the container. By employing the resin wafer, heat treatment of the containers typically will not be performed at significantly high temperatures. As a result, significant stresses exist in the walls of the container because the walls are not sufficiently stress relieved. Over time and repeated use, these stresses may compromise the integrity of the container. Additionally, many of these containers are manufactured such that the surfaces of the resulting products have significant amounts of microbes on them, thus presenting sanitation concerns. Moreover, many of these containers and/or beverage holders are often manufactured such that cleaning them in a common household dishwasher results in significant amounts of degradation. That is, the containers are typically not dishwasher safe. Finally, it is often desirable for containers to have different appearances, for example, other than a typical restaurant/kitchen appearance.

SUMMARY

These needs and others are met by embodiments of the disclosed concept, which are directed to a novel sleeve member, container assembly kit including the same, and associated method of manufacturing a sleeve member.

In accordance with one aspect of the disclosed concept, a sleeve member is provided. The sleeve member includes a bellows member having a top and a bottom located opposite the top, and an inner liner located internal with respect to the bellows member. The inner liner has a top and a bottom located opposite the top of the inner liner. The top and the bottom of the inner liner are connected to the top and the bottom of the bellows member, respectively, such that a vacuum entrapment is provided between the bellows member and the inner liner. A passage is provided through the top and the bottom of the bellows member, and through the top and the bottom of the inner liner.

In accordance with another aspect of the disclosed concept, a container assembly kit is provided. The container assembly kit includes the aforementioned sleeve member, and a shell member having a body having a tubular wall and a base. The tubular wall has an end located proximate the bottom of the bellows member and the bottom of the inner liner. The base extends across the end of the tubular wall. The tubular wall extends from the base to proximate the top of the bellows member and the top of the inner liner. The tubular wall is concentric with the inner liner and external with respect to the bellows member.

In accordance with another aspect of the disclosed concept, another container assembly kit is provided. The container assembly kit includes the aforementioned sleeve member, and a cup coupled to the sleeve member. The cup has an open top, a closed bottom, and a tubular wall extending therebetween. The tubular wall is located internal with respect to the sleeve member.

In accordance with another aspect of the disclosed concept, a method of manufacturing the aforementioned sleeve member is provided. The method includes the steps of providing a bellows member having a top and a bottom located opposite the top, providing an inner liner having a top and a bottom located opposite the top of the inner liner, inserting the inner liner into an interior of the bellows member such that a passage is provided through the top and the bottom of the bellows member, and through the top and the bottom of the inner liner, connecting the top of the inner liner to the top of the bellows member, connecting the bottom of the inner liner to the bottom of the bellows member, and providing a vacuum entrapment between the bellows member and the inner liner.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
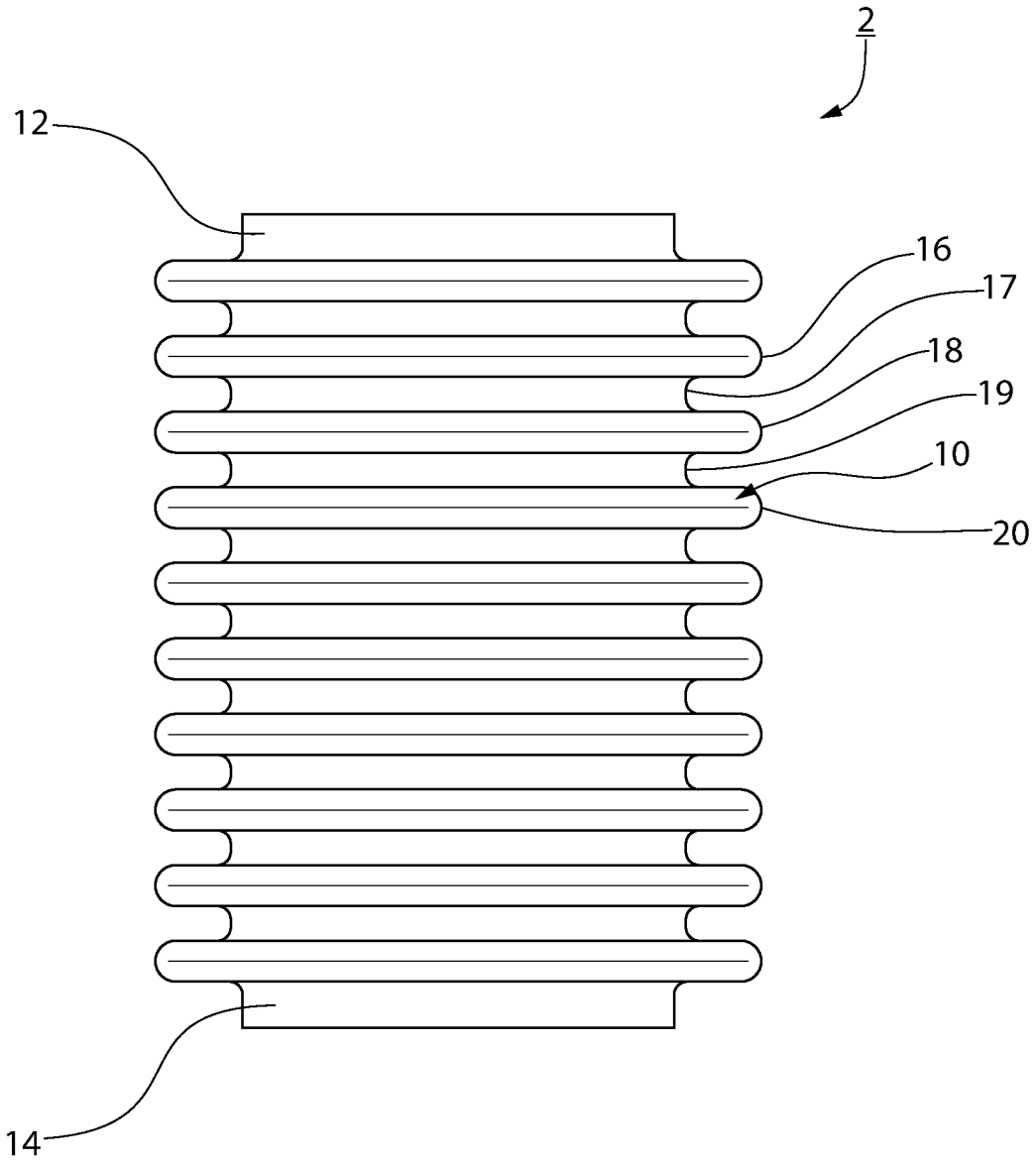
FIG. 1 is a front view of a sleeve member, in accordance with one non-limiting embodiment of the disclosed concept.
Figure 2:
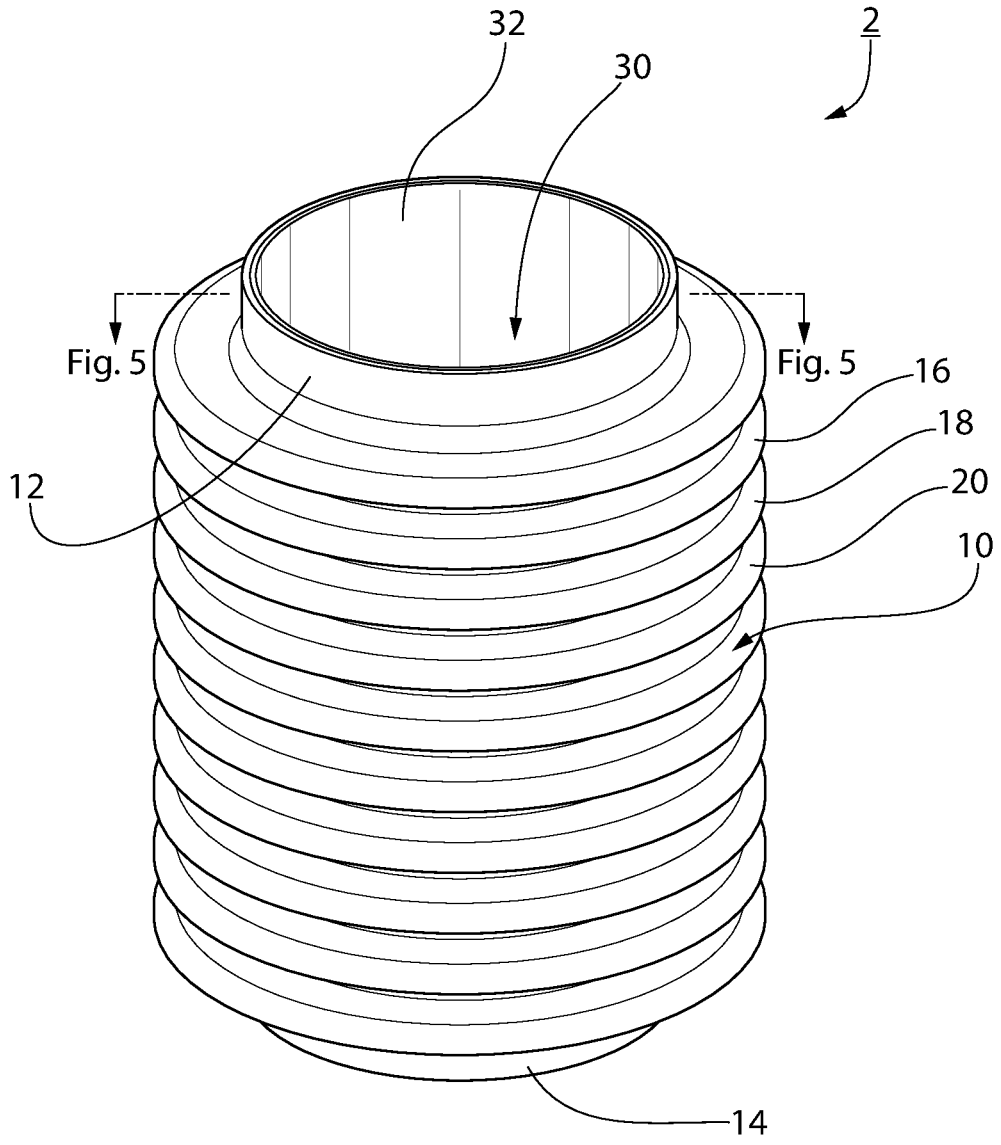
FIG. 2 and FIG. 3 are different isometric views of the sleeve member of FIG. 1.

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "vacuum entrapment" shall mean a space in which the pressure is less than $10^{-2}$ torr.

FIGS. 1-5 are different views of a novel sleeve member 2, in accordance with one non-limiting embodiment of the disclosed concept. The example sleeve member 2 is used to insulate, for example, beverages, such as beverages in an example beverage can 100, shown in FIGS. 7-9, and beverages in an example cup 302, shown in FIGS. 12-14. Accordingly, as will be discussed in greater detail below, the sleeve member 2 significantly minimizes the amount of heat that is able to pass into and out of beverages within the beverage can 100 and the cup 302, provides a different physical appearance for users than traditional containers, and includes a number of additional advantages. For example, the sleeve member 2 may advantageously be cleaned within typical residential dishwashers without significant concern for corrosion, may be manufactured at significantly higher temperatures than prior art containers (not shown), and may have a surface finish significantly devoid of contaminating microbes.

Continuing to refer to FIGS. 1-5, the sleeve member 2 includes a bellows member 10 and an inner liner 30 connected to the bellows member 10. While the inner liner 30 is generally cylindrical-shaped, the bellows member 10 is a generally corrugated outer structure which provides for a number of novel advantages, as will be discussed below. It will, however, be appreciated that suitable alternative geometries are contemplated herein. The bellows member 10 and the inner liner 30 each have a corresponding top 12,32 and a corresponding bottom 14,34 located opposite the top 12,32. The inner liner 30, which has a relatively shiny (e.g., without limitation, able to reflect light and/or is polished) outer surface, is located internal with respect to the bellows member 10. Furthermore, the top 32 and the bottom 34 of the inner liner 30 are connected to the top 12 and the bottom 14 of the bellows member 10, respectively, such that a vacuum entrapment is provided between the bellows member 10 and the inner liner 30. In one example embodiment, the pressure between the bellows member 10 and the inner liner 30 is less than $10^{-4}$ torr, thus providing for a relatively deep vacuum entrapment. The process of creating the vacuum entrapment between the bellows member 10 and the inner liner 30 will be discussed below. In one example embodiment, the top 12 and the bottom 14 of the bellows member 10 are connected to the top 32 and the bottom 34 of the inner liner 30, respectively, via a respective first weld and a respective second weld. The first and second welds are preferably circumferential welds.

In one example embodiment, each of the bellows member 10 and the inner liner 30 is made of metal, and has a corresponding grain extending longitudinally from the corresponding top 12,32 to the corresponding bottom 14,34. As discussed above, the example sleeve member 2 is preferably manufactured in order to allow consumers to clean it in a common household dishwasher. In order to achieve this benefit, the bellows member 10 and the inner liner may be made of 316L stainless steel. 316L stainless steel provides significant advantages in terms of protection against chloride degradation. Typical prior art containers (not shown), by way of contrast, are commonly made of food grade 18-8 stainless steel, a material that, while generally less expensive than 316L, is more susceptible to chloride degradation.

Figure 3:
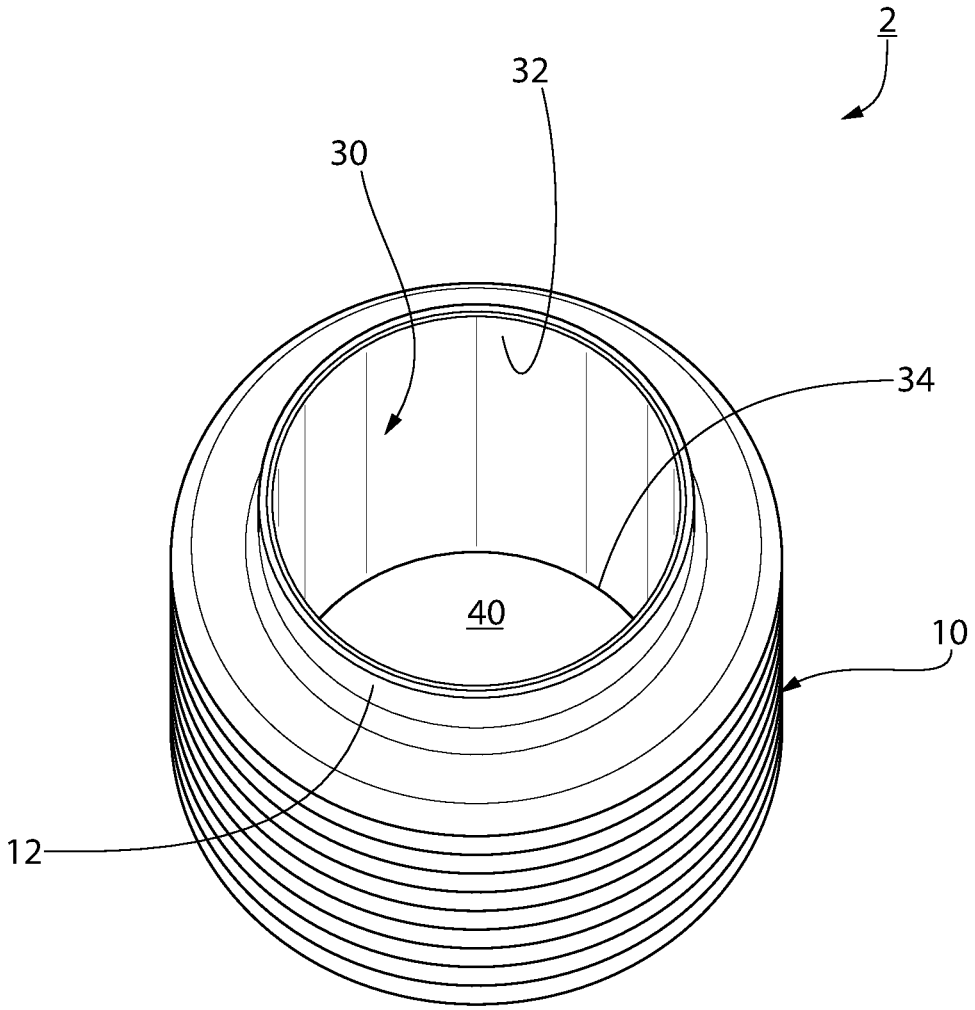

As shown in FIG. 3, a passage 40 is provided through the top 12 and the bottom 14 (see FIGS. 1 and 2) of the bellows member 10, and through the top 32 and the bottom 34 of the inner liner 30. As a result, if a user desires to remove either one of the beverage can 100 or the cup 302 from the sleeve member 2, the user can relatively easily move (i.e., push or pull) the beverage can 100 or the cup 302 with respect to the sleeve member 2, as both ends of the sleeve member 2 are open. Furthermore, by having open ends, a user can insert the beverage can 100 into either end of the sleeve member 2, rather than only one open end, as is the case with many traditional containers. This provides for a more versatile insulating product.

Figure 5:
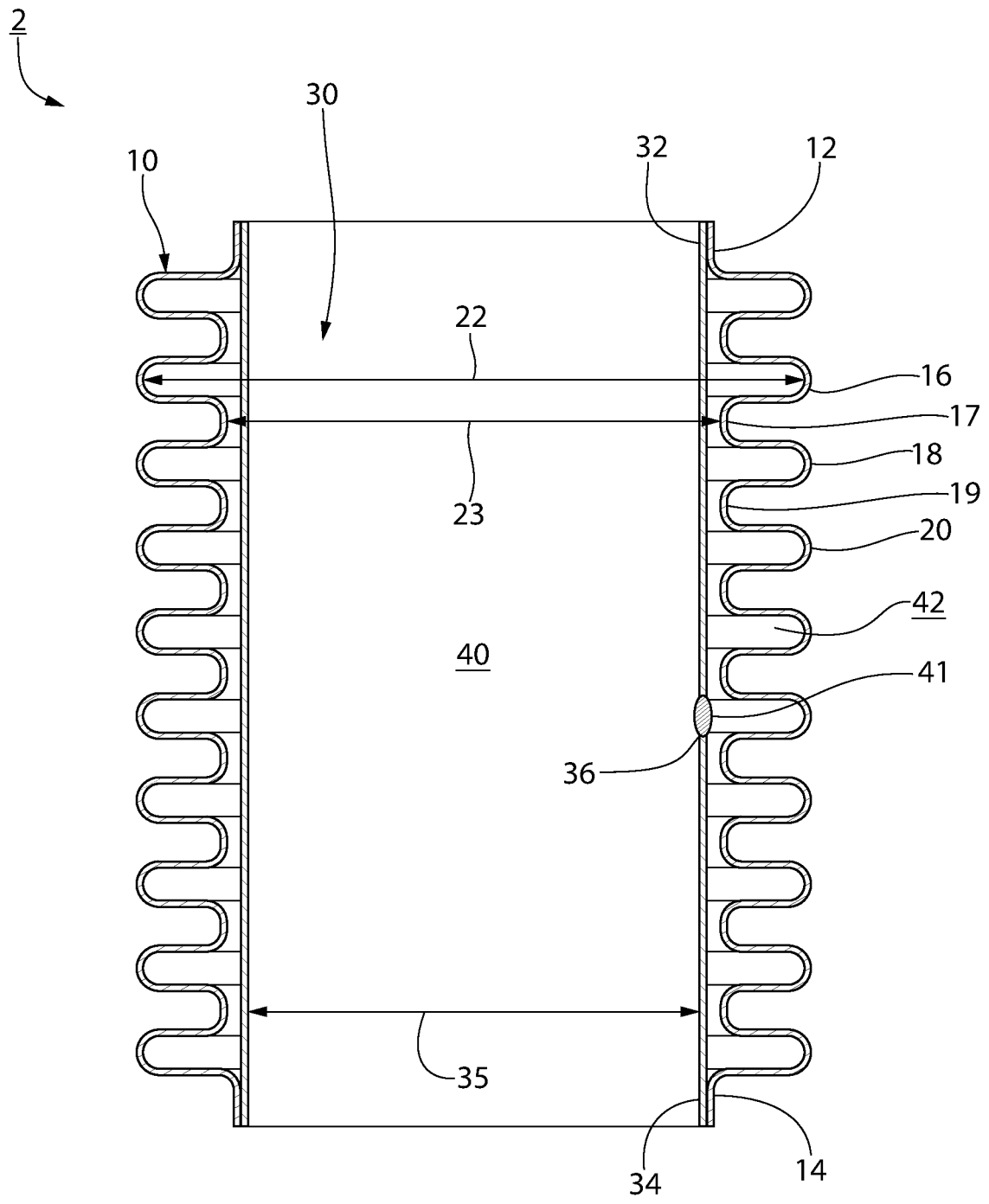
FIG. 5 is a section view of the sleeve member of FIG. 2.

Referring to FIG. 5, the bellows member 10 includes a plurality of annular-shaped peaks (only three peaks 16,18,20 are indicated in FIG. 5) and a plurality of annular-shaped recessed portions (only two recessed portions 17,19 are indicated in FIG. 5) each having a diameter (only the diameter 22 of the first peak and the diameter 23 of the first recessed portion 17 are shown). Each of the recessed portions 17,19 extends between two of the peaks 16,18,20. Furthermore, it will be appreciated that the diameter 22 of each of the peaks 16,18,20 is greater than the diameter 23 of each of the recessed portions 17,19. Additionally, the inner liner 30 has a diameter 35 less than the diameter 23 of each of the recessed portions 17,19. Accordingly, the bellows member 10 provides the sleeve member 2 with a corrugated exterior. As such, the bellows member 10 is similar to bellows members commonly employed in other applications such as in the automotive industry (e.g., without limitation, automotive exhaust-gas-recirculation tubes), in the medical industry (e.g., without limitation, in heat exchangers used in coronary bypass), in the aerospace industry (e.g., without limitation, air frame ducting systems including de-icing structures), and in, for example, expansion joint applications (e.g., without limitation, petrochemical and coke plants to address expansion and contraction in lines due to thermal cycle changes). This provides the sleeve member 2 with a generally 'Industrial' type appearance, which may desirable in the market for insulating products.

The bellows member 10 also provides a means by which a chamber 42 between the bellows member 10 and the inner liner 30 can be relatively large in terms of volume. This is advantageous in that greater insulation may be provided to beverages contained within the sleeve member 2. That is, the increased volume provided by the bellows member 10 provides a larger barrier for heat that might otherwise enter or exit the interior of the sleeve member 2, where beverages are located. Prior art containers (not shown), by way of contrast, typically include two cylindrical-shaped walls wherein the diameter of the outer wall is not significantly greater than the diameter of the inner wall.

Figure 4:
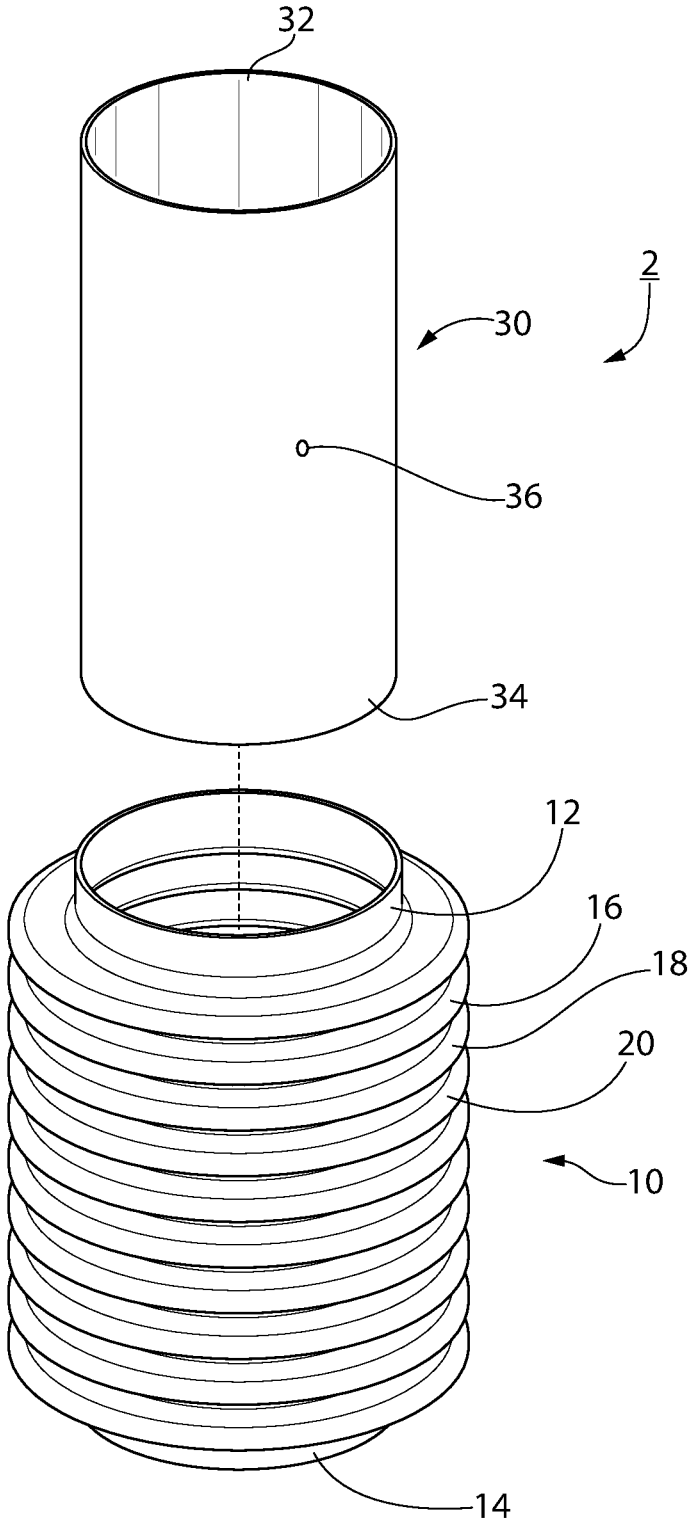
FIG. 4 is an exploded isometric view of the sleeve member of FIGS. 2 and 3.

As shown in FIG. 4, the inner liner 30 has a weep hole (i.e., a thru hole) 36. As shown in simplified form in FIG. 5, the sleeve member 2 further has a sealing material 41 that seals the weep hole 36. In one example embodiment, the sealing material 41 is formed from a brazing material. During manufacturing, a vacuum exhaust treatment is performed through the weep hole 36. Because the sealing material 41 is formed from a brazing material, as opposed to a resin wafer, as is the case in many prior art containers (not shown), heat treatment of the sleeve member is advantageously able to be performed at relatively high temperatures (e.g., without limitation, temperatures greater than 1600 degrees Fahrenheit).

Accordingly, it will be appreciated that a method of manufacturing the sleeve member 2 includes the steps of providing the bellows member 10, providing the inner liner 30, inserting the inner liner 30 into an interior of the bellows member 10 such that the passage 40 is provided through the top 12 and the bottom 14 of the bellows member 10, and through the top 32 and the bottom 34 of the inner liner 30, connecting the top 32 of the inner liner 30 to the top 12 of the bellows member 10, connecting the bottom 34 of the inner liner 30 to the bottom 14 of the bellows member 10, and providing a vacuum entrapment between the bellows member 10 and the inner liner 30. The connecting the top 32 of the inner liner 30 to the top 12 of the bellows member 10 step may further include circumferentially welding the top 32 of the inner liner 30 to the top 12 of the bellows member 10. The connecting the bottom 34 of the inner liner 30 to the bottom 14 of the bellows member 10 step may further include circumferentially welding the bottom 34 of the inner liner 30 to the bottom 14 of the bellows member 10.

It will further be appreciated that the method includes the steps of heat treating the inner liner 30 and the bellows member 10 at a temperature greater than 1600 degrees Fahrenheit. In a preferred implementation of the disclosed concept, the method further includes heat treating the inner liner 30 and the bellows member 10 at a temperature greater than 1800 degrees Fahrenheit. As discussed above, the sleeve member 2 may be manufactured such that it has a surface finish that is substantially devoid of contaminating microbes. In order to achieve this benefit, the method of manufacturing the sleeve member 2 may further include bright annealing the inner liner 30 and the bellows member 10 with nitrogen gas in order to stress relieve the inner liner 30, the bellows member 10, and the connections therebetween. Accordingly, the method may further include providing the vacuum entrapment without oxidation between the bellows member 10 and the inner liner 30.

Figure 6:
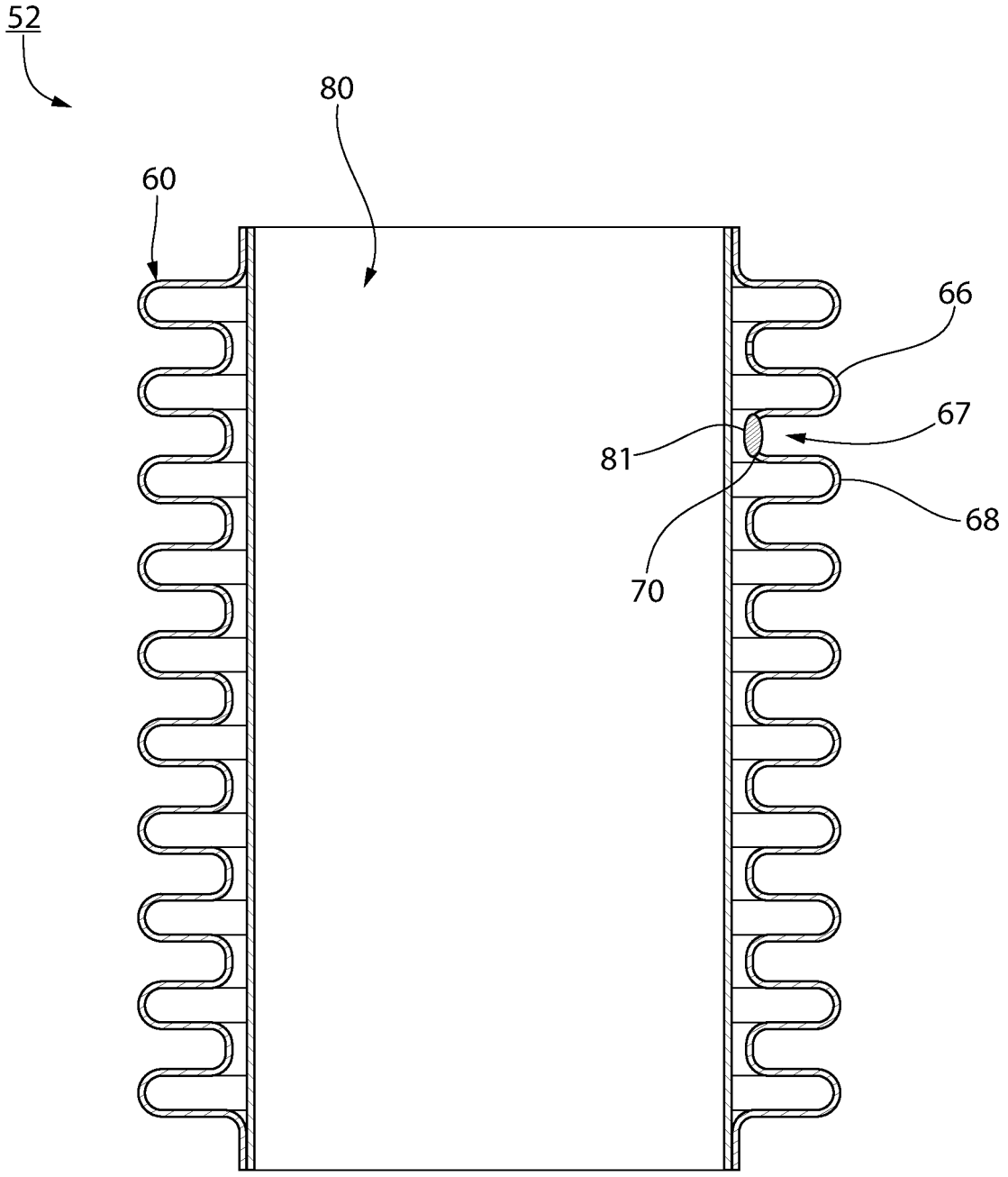
FIG. 6 is a section view of another sleeve member, in accordance with another non-limiting embodiment of the disclosed concept.

FIG. 6 shows a section view of another sleeve member 52, in accordance with another non-limiting embodiment of the disclosed concept. The example sleeve member 52 is substantially the same as the sleeve member 2 in that it includes a bellows member 60 and an inner liner 80 connected to the bellows member. For purposes of economy of disclosure, only significant differences between the sleeve member 2 and the sleeve member 52 will be discussed in detail. The bellows member 60 has a first peak 66, a second peak 68 and a recessed portion 67 extending between the peaks 66,68. The recessed portion 67 of the bellows member 60 has a weep hole (i.e., thru hole) 70. As shown, the sleeve member 52 further includes a sealing material 81 sealing the weep hole 70. In one example embodiment, the sealing material 81 is formed from a brazing material and functions substantially the same as the sealing material 41. That is, a vacuum entrapment is able to be formed between the bellows member 60 and the inner liner 80 via the weep hole 70 and the sealing material 81. Accordingly, it will be appreciated that a vacuum entrapment is advantageously able to be achieved by locating a weep hole on either of the bellows member 10,60 or the inner liner 30,80. Furthermore, with respect to the sleeve member 52, locating the weep hole 70 in the recessed portion 67 may simplify manufacturing in that the sealing material 81 will have a pocket to settle in, as opposed to being on the peaks 66,68, where it might not settle as easily.

Figure 7:
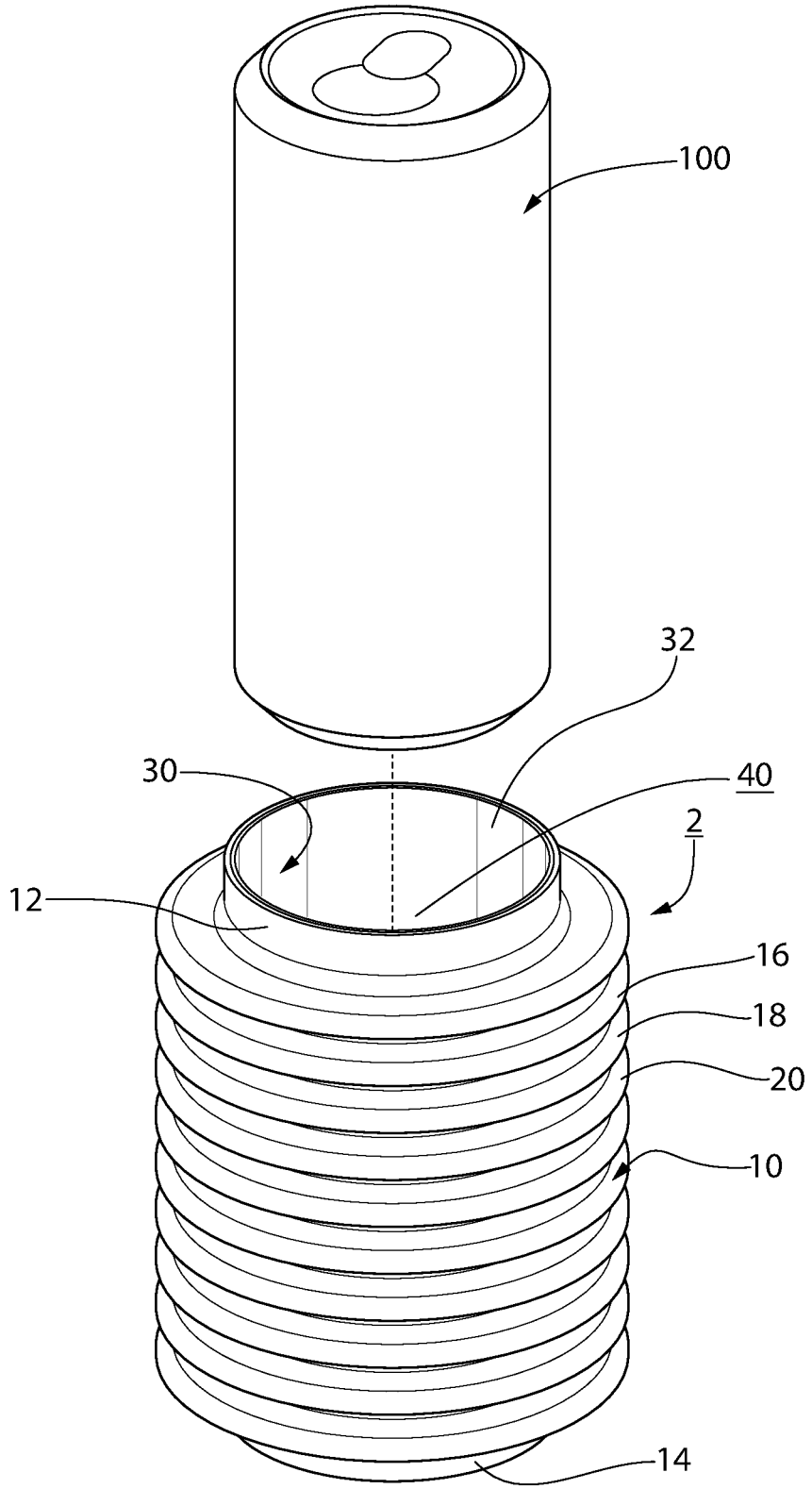
FIG. 7 is an isometric view of the sleeve member of FIG. 5, shown with a beverage can before the beverage can has been inserted into the sleeve member.
Figure 8:
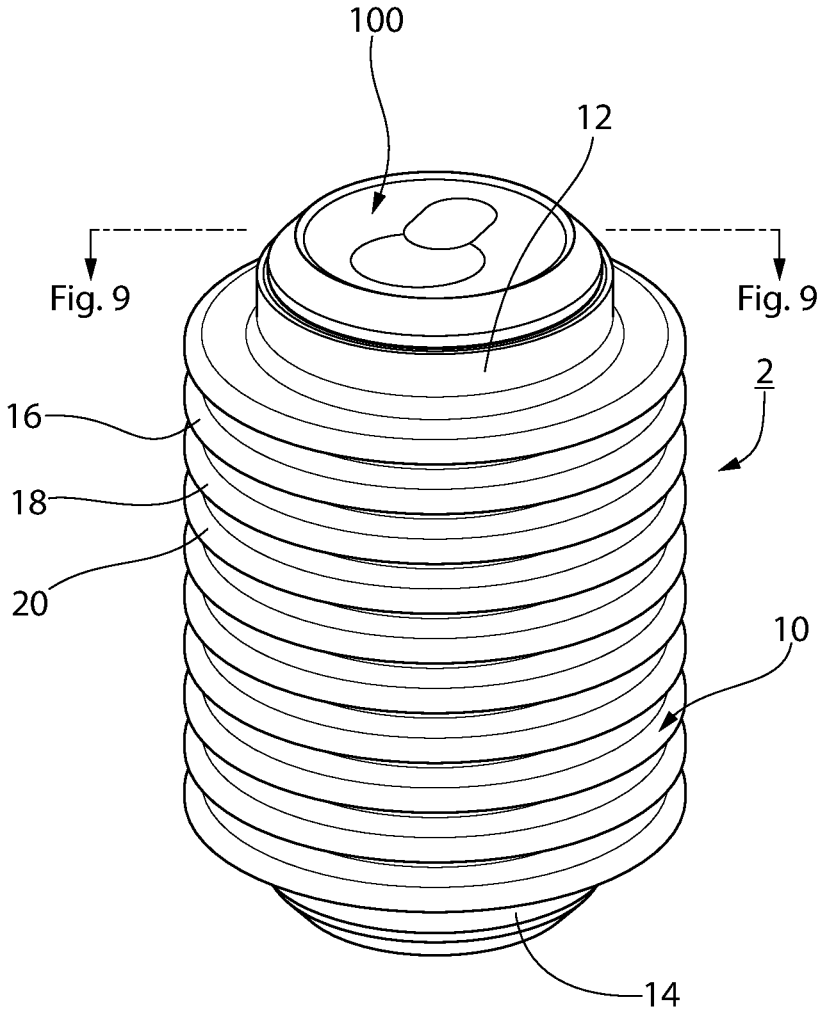
FIG. 8 is an isometric view of the sleeve member of FIG. 7, shown with the beverage can inserted into the sleeve member.
Figure 9:
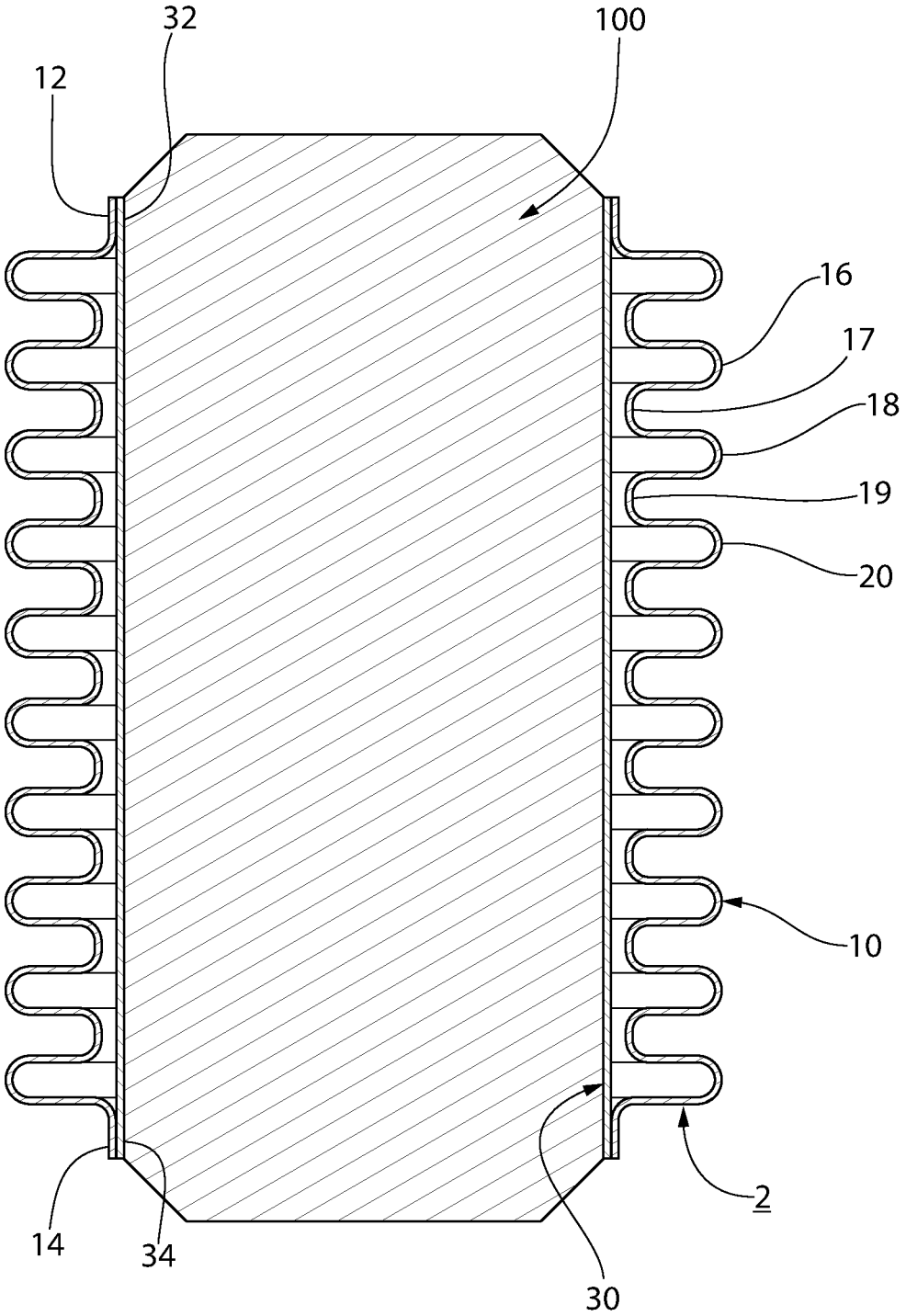
FIG. 9 is a section view of the sleeve member and can of FIG. 8.

FIGS. 7-9 show different views of the sleeve member 2 with the beverage can 100. The sleeve member 2, or a suitable similarly structured sleeve member (not shown), may be configured to surround any size can and/or container. For example and without limitation, the beverage can 100 may be a twelve ounce or sixteen ounce beverage can. It will also be appreciated that the sleeve member 2, or a similar suitable alternative sleeve member, may be used to insulate alternative containers (e.g., without limitation, multiple gallon coolers for baseball dugouts and/or picnic baskets). With respect to picnic baskets (not shown), the sleeve member may be manufactured in any suitable alternative shape, and may further include an internal divider to allow food to be kept both hot and cold.

Figure 10:
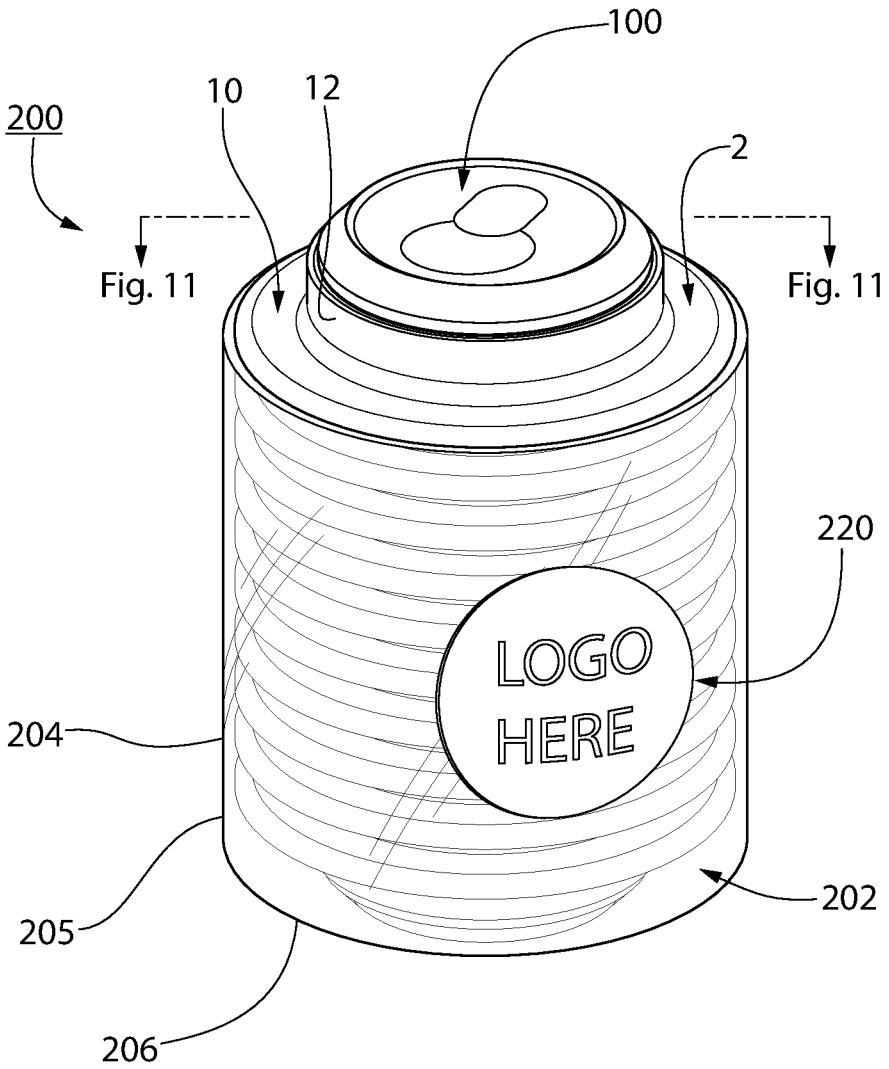
FIG. 10 is an isometric view of a container assembly kit, shown with a beverage can, in accordance with another non-limiting embodiment of the disclosed concept.
Figure 11:
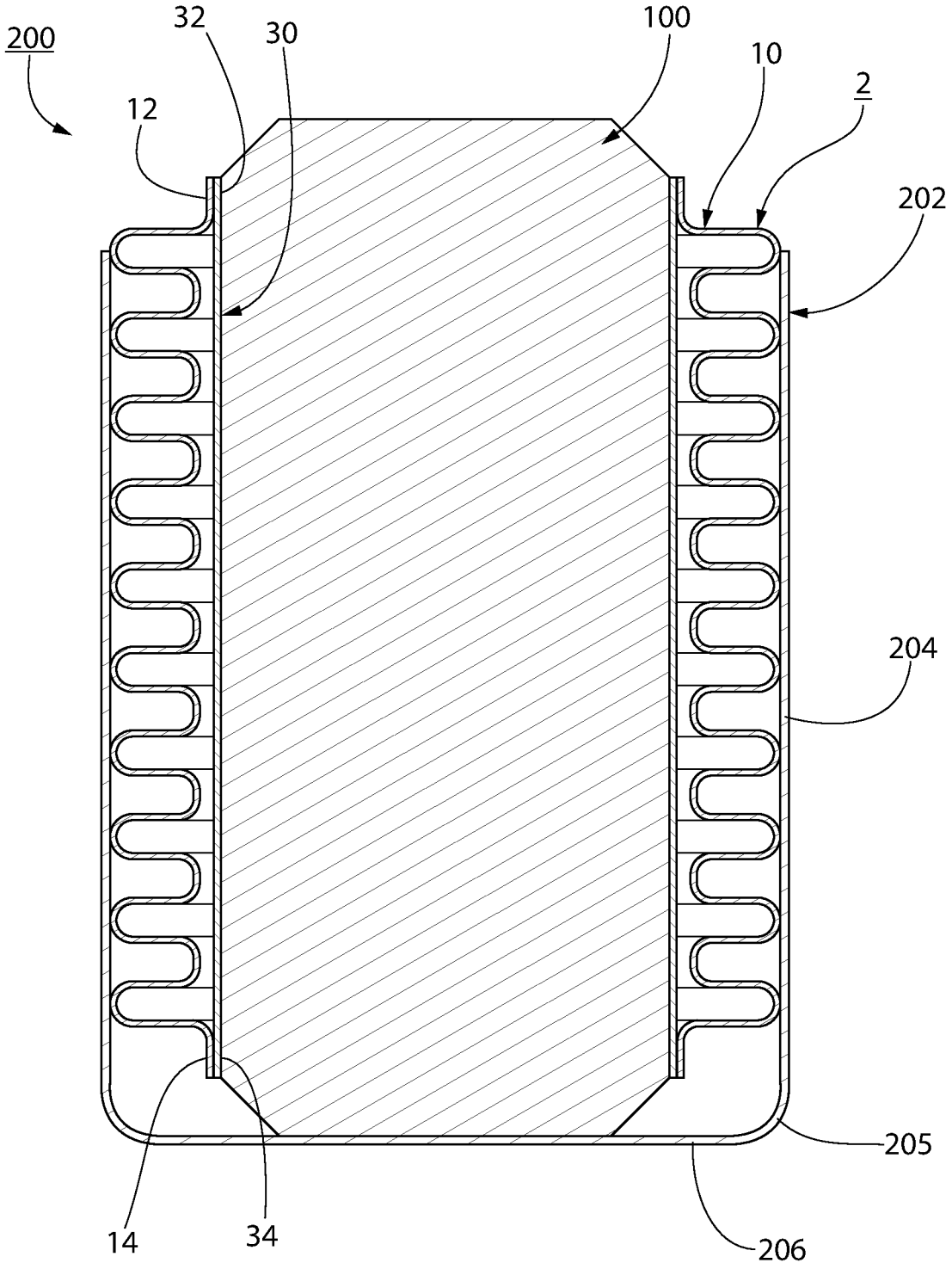
FIG. 11 is a section view of the container assembly kit and can of FIG. 10.

FIGS. 10 and 11 show different views of a container assembly kit 200, shown with the beverage can 100, in accordance with another non-limiting embodiment of the disclosed concept. The container assembly kit 200 includes the sleeve member 2 and a shell member 202. The shell member 202 includes a body having a tubular wall 204 and a base 206. The tubular wall 204 has an end 205 located proximate the bottom 14 of the bellows member 10 and the bottom 34 of the inner liner 30. The base 206 extends across the end 205 of the tubular wall 204. The tubular wall 204 extends from the base 206 to proximate the top 12 of the bellows member 10 and the top 32 of the inner liner 30. The tubular wall 204 is concentric with the inner liner 30 and external with respect to the bellows member 10.

In one example embodiment, the body of the shell member 202 is substantially transparent (e.g., without limitation, made of a generally transparent thermoplastic material). In this manner, the shell member 202 advantageously allows users to view the novel geometry of the sleeve member 2. Furthermore, as shown in FIG. 10, the container assembly kit 200 may optionally further include a branding means, such as, for example, a sticker 220 which may include a logo. As such, users can personalize their container assembly kit by, for example, putting unique stickers on the shell member 202.

Figure 12:
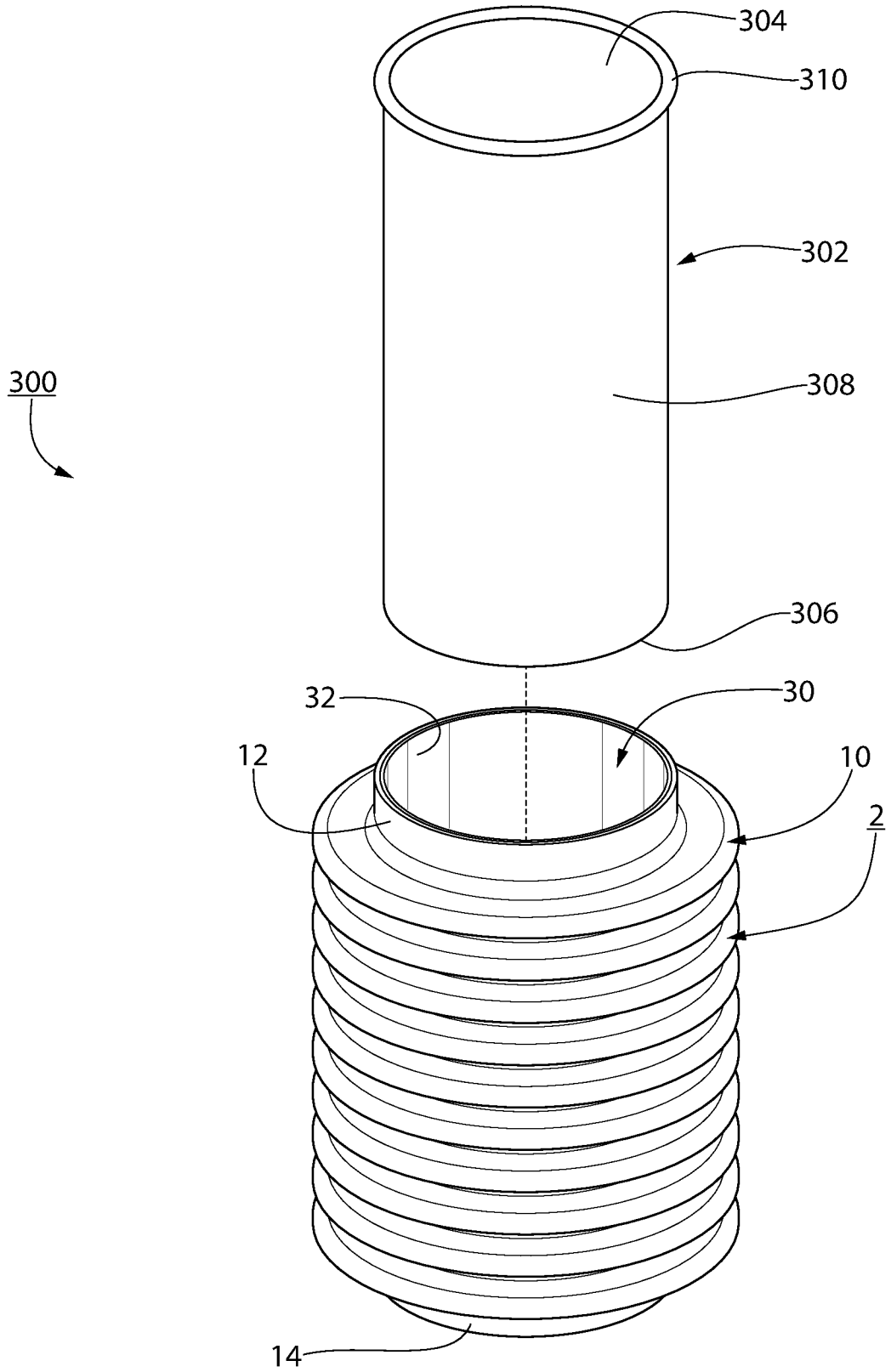
FIG. 12 is an exploded isometric view of another container assembly kit, in accordance with another non-limiting embodiment of the disclosed concept.
Figure 13:
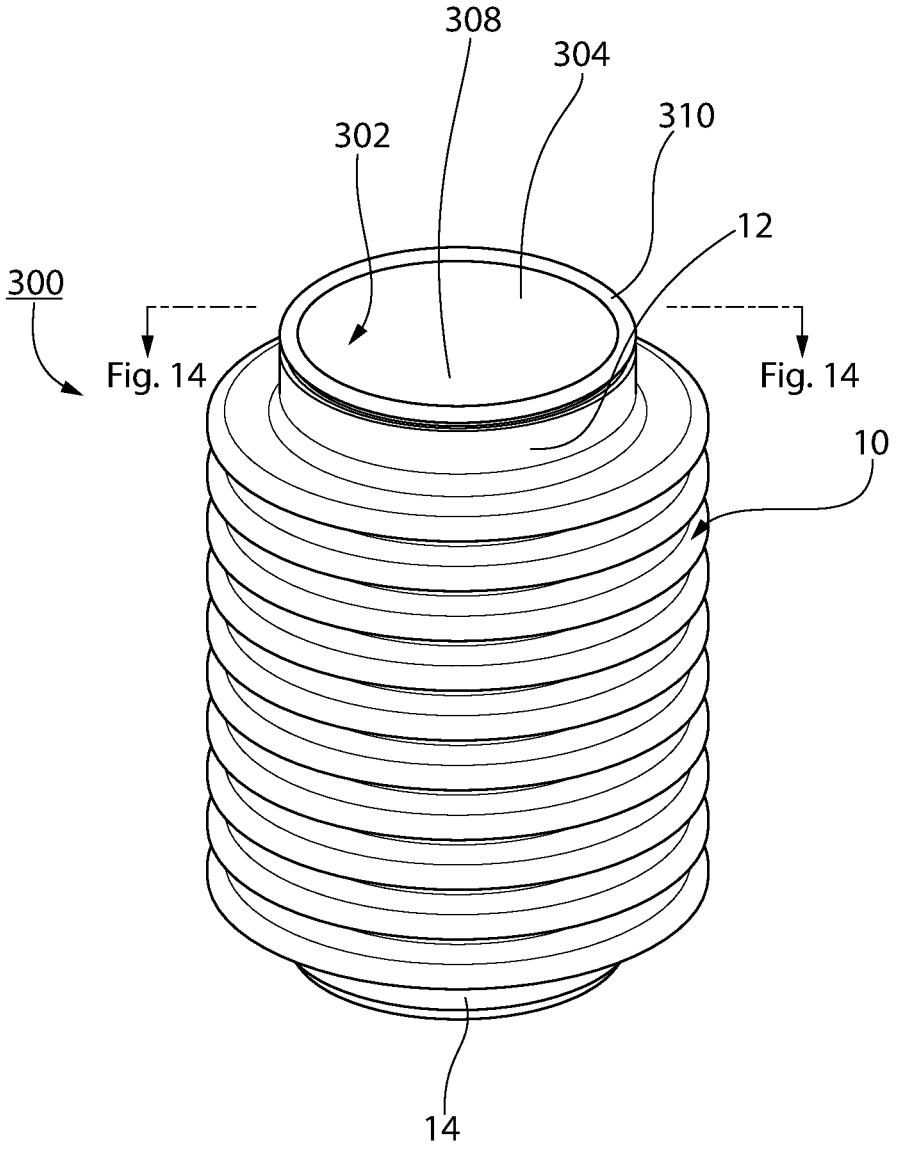
FIG. 13 is an assembled isometric view of the container assembly kit of FIG. 12.
Figure 14:
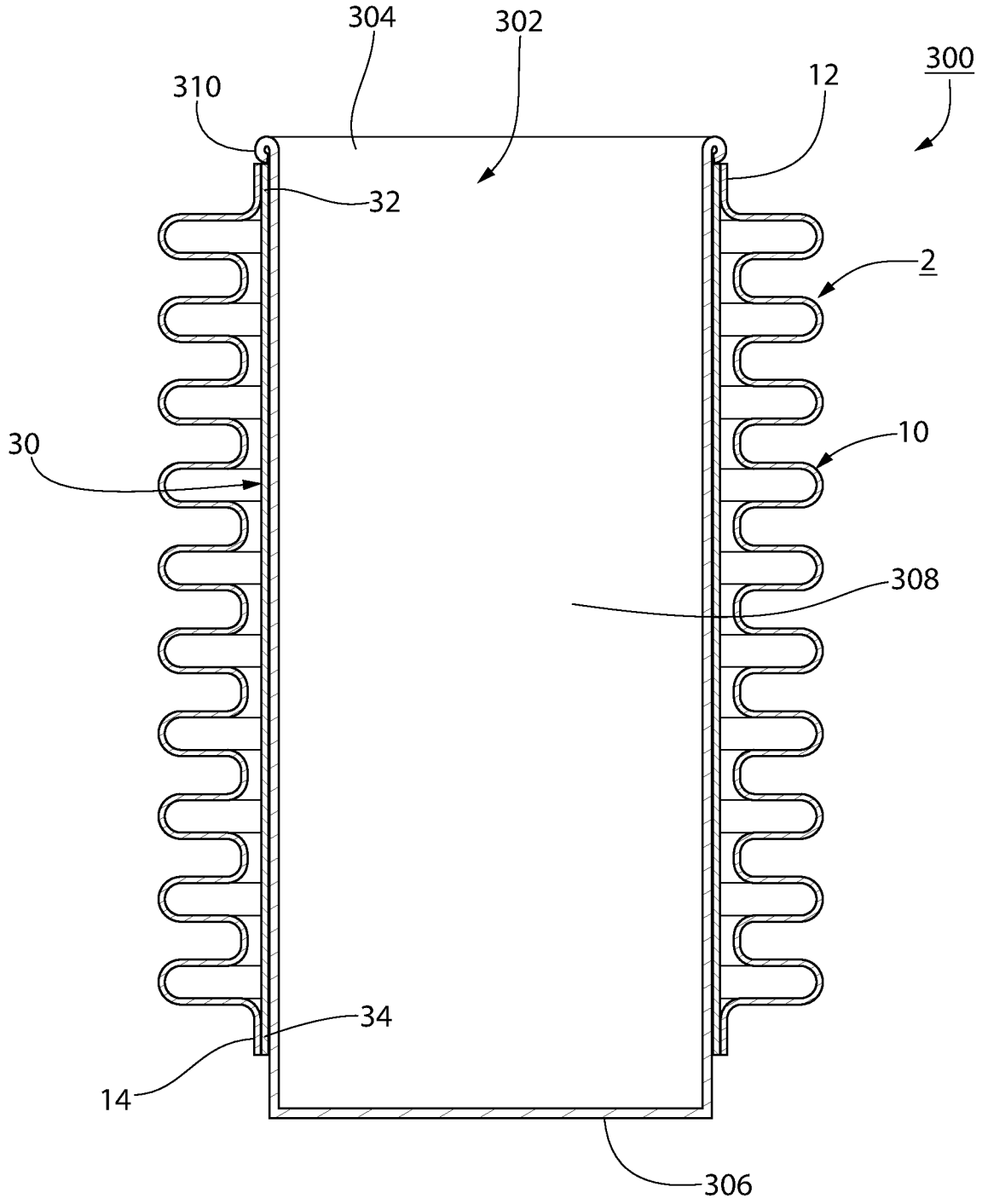
FIG. 14 is a section view of the container assembly kit of FIG. 13.

FIGS. 12-14 show different views of another container assembly kit 300, in accordance with another non-limiting embodiment of the disclosed concept. The container assembly kit 300 includes the sleeve member 2 and the cup 302. The cup 302 has an open top 304, a closed bottom 306, and a tubular wall 308 extending therebetween. As shown in FIG. 14, when the cup 302 is coupled to the sleeve member 2, the top 304 of the cup 302 is located proximate the top 12 of the bellows member 10 and the top 32 of the inner liner 30, and the bottom 306 of the cup 302 is located proximate the bottom 14 of the bellows member 10 and the bottom 34 of the inner liner 30. Additionally, as shown in FIG. 14, the top 304 of the cup 302 has a curl 310 engaging at least one of the top 12 of the bellows member 10 and the top 32 of the inner liner 30 in order to maintain the cup 302 on the sleeve member 2.

Figure 15:
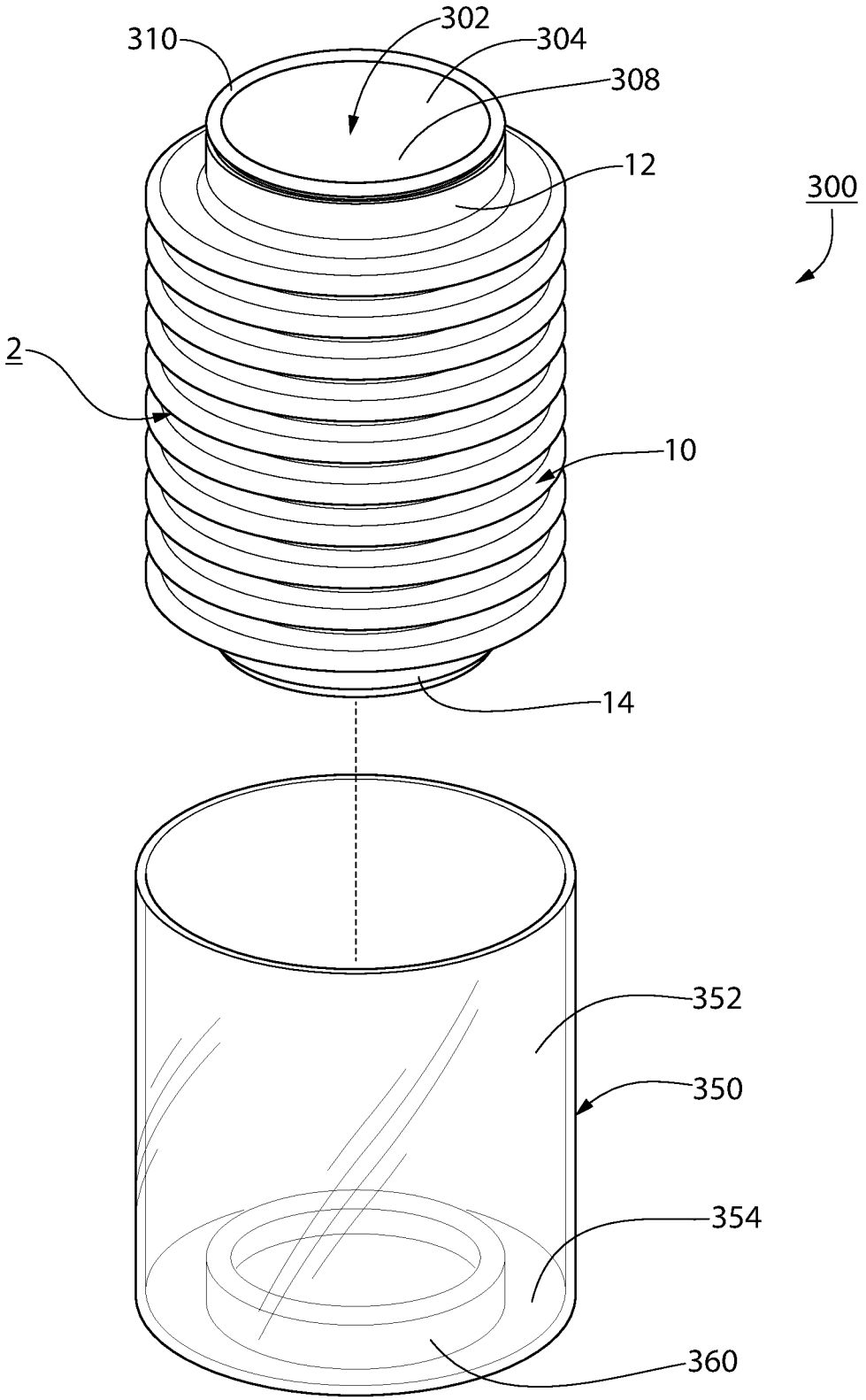
FIG. 15 is an exploded isometric view of the container assembly kit of FIG. 14, also shown including a shell member.
Figure 16:
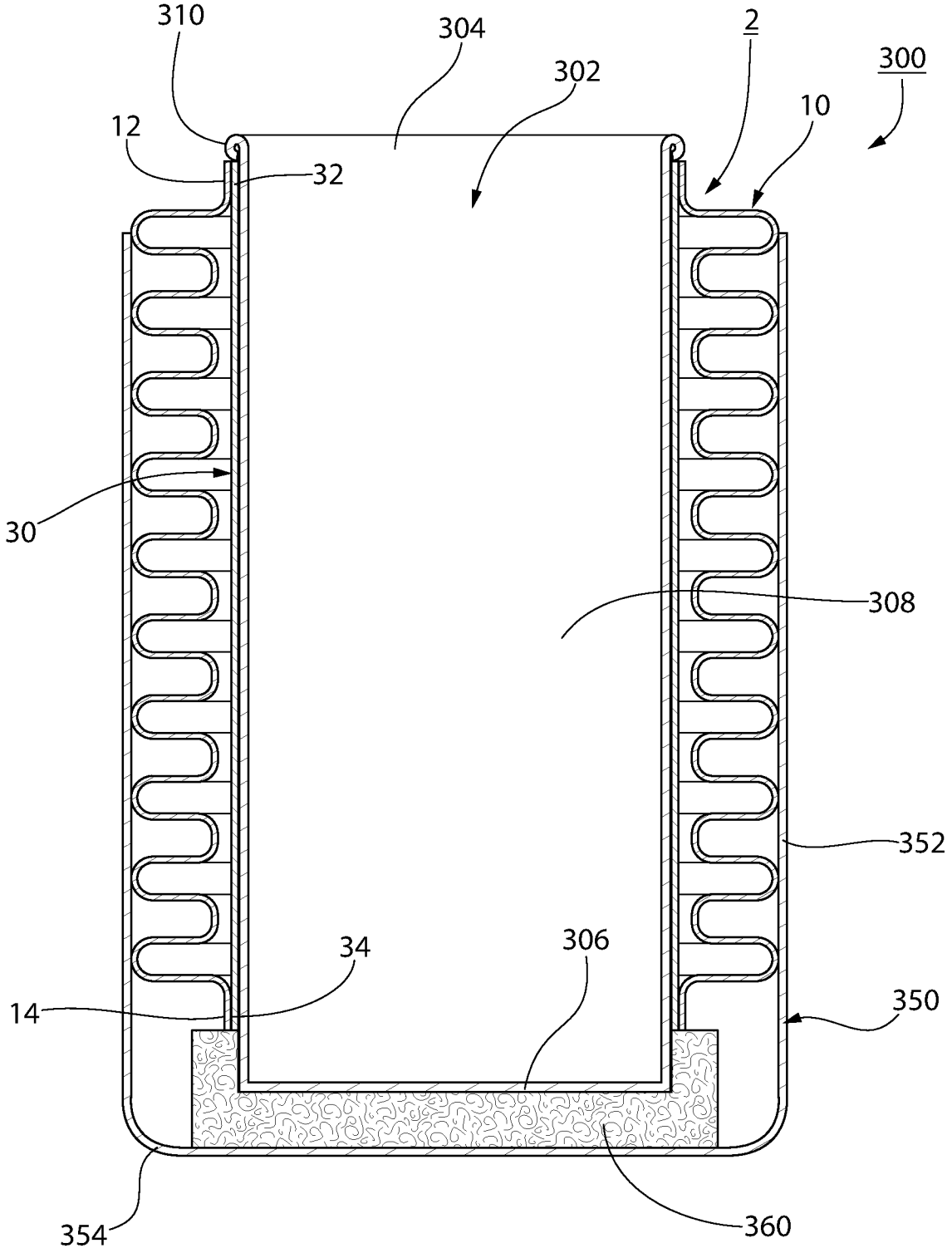
FIG. 16 is a section view of the container assembly kit of FIG. 15, with components assembled.

FIGS. 15 and 16 show additional views of the container assembly kit 300. As shown, the container assembly kit 300 may further include a shell member 350. The shell member 350 is similar to the shell member 202, discussed above, in that it includes a body, optionally transparent, having a tubular wall 352 and a base 354. However, the shell member 350 further includes an insulative member (e.g., without limitation, foam member 360) affixed to the base 354. As shown in FIG. 16, the foam member 360 engages the sleeve member 2 and the bottom 306 of the cup 302. In this manner, the container assembly kit 300 advantageously provides further insulation in that the foam member 360 will minimize the likelihood that heat will pass through the bottom of the sleeve member 2. That is, in addition to providing insulation longitudinally along the length of the sleeve member 2, the container assembly kit 300 provides an additional layer of insulation laterally along the bottom of the sleeve member 2. It will also be appreciated that the shell member 350 could be substituted into the container assembly kit 200 (FIGS. 10 and 11) in place of the shell member 202.

Figure 17:
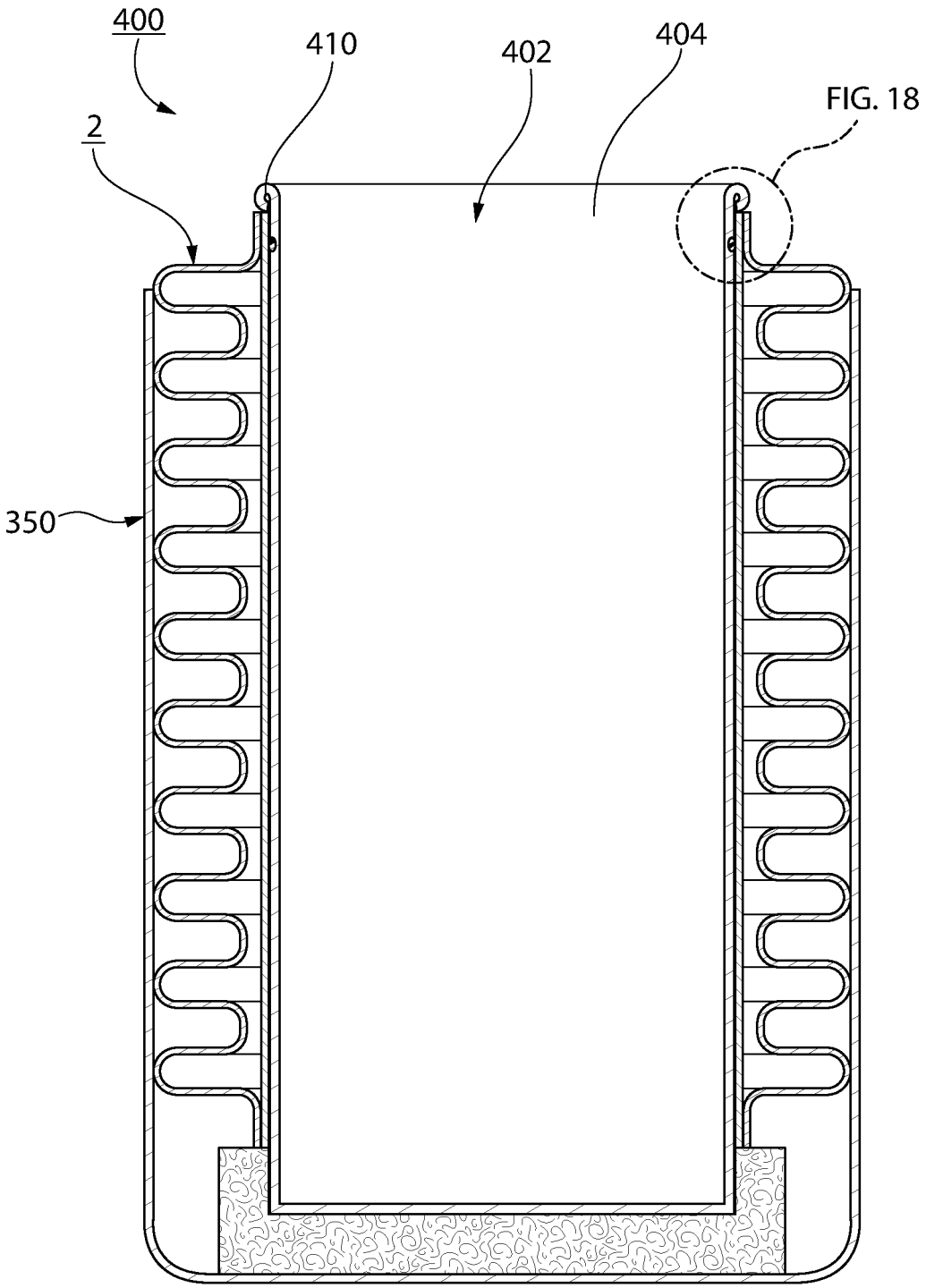
FIG. 17 is a section view of another container assembly kit, in accordance with another non-limiting embodiment of the disclosed concept.
Figure 18:
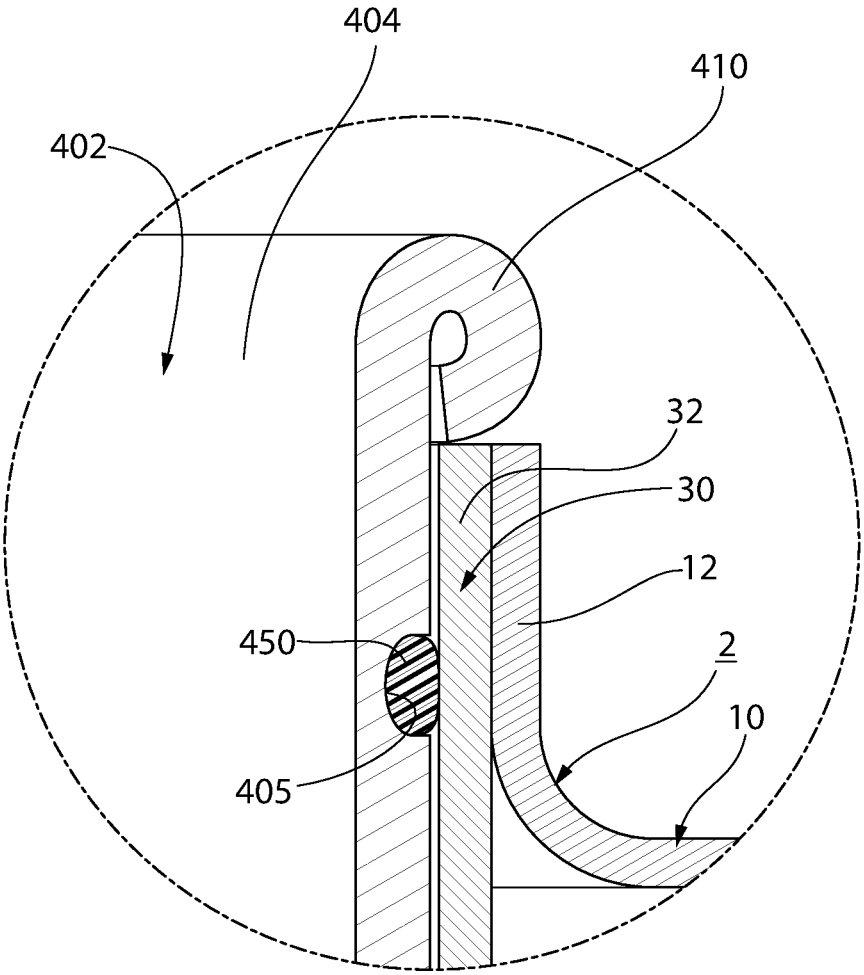
FIG. 18 is an enlarged view of a portion of the container assembly kit of FIG. 17.

FIGS. 17 and 18 show section views of another container assembly kit 400, in accordance with another non-limiting embodiment of the disclosed concept. The container assembly kit 400 is substantially the same as the container assembly kit 300, discussed above. As such, for purposes of economy of disclosure, only significant differences will be discussed in detail. The container assembly kit 400 includes the sleeve member 2, the shell member 350, a cup 402, and an annular-shaped gasket member 450 (see FIG. 18). The cup 402 has an open top 404 having a curl 410. The gasket member 450 is preferably made of any suitable elastomeric material. The gasket member 450 is coupled to the cup 402 proximate the curl 410. In one example embodiment, the top 404 of the cup 402 has an annular-shaped grooved region 405 and the gasket member 450 is coupled to the grooved region 405. It will, however, be appreciated that suitable alternative cups are contemplated herein. For example and without limitation, a cup may have a grooved region that is not annular-shaped, or may not have a grooved region at all.

Continuing to refer to FIGS. 17 and 18, the gasket member 450 is located between the top 32 of the inner liner 30 and the top 404 of the cup 402. In this manner, the gasket member 450 advantageously assists in maintaining the cup 402 on the sleeve member 2. That is, the friction between the gasket member 450 and the top 32 of the inner liner 30 significantly minimizes the likelihood that the cup 402 will inadvertently be exited from the sleeve member 2.

Figure 19:
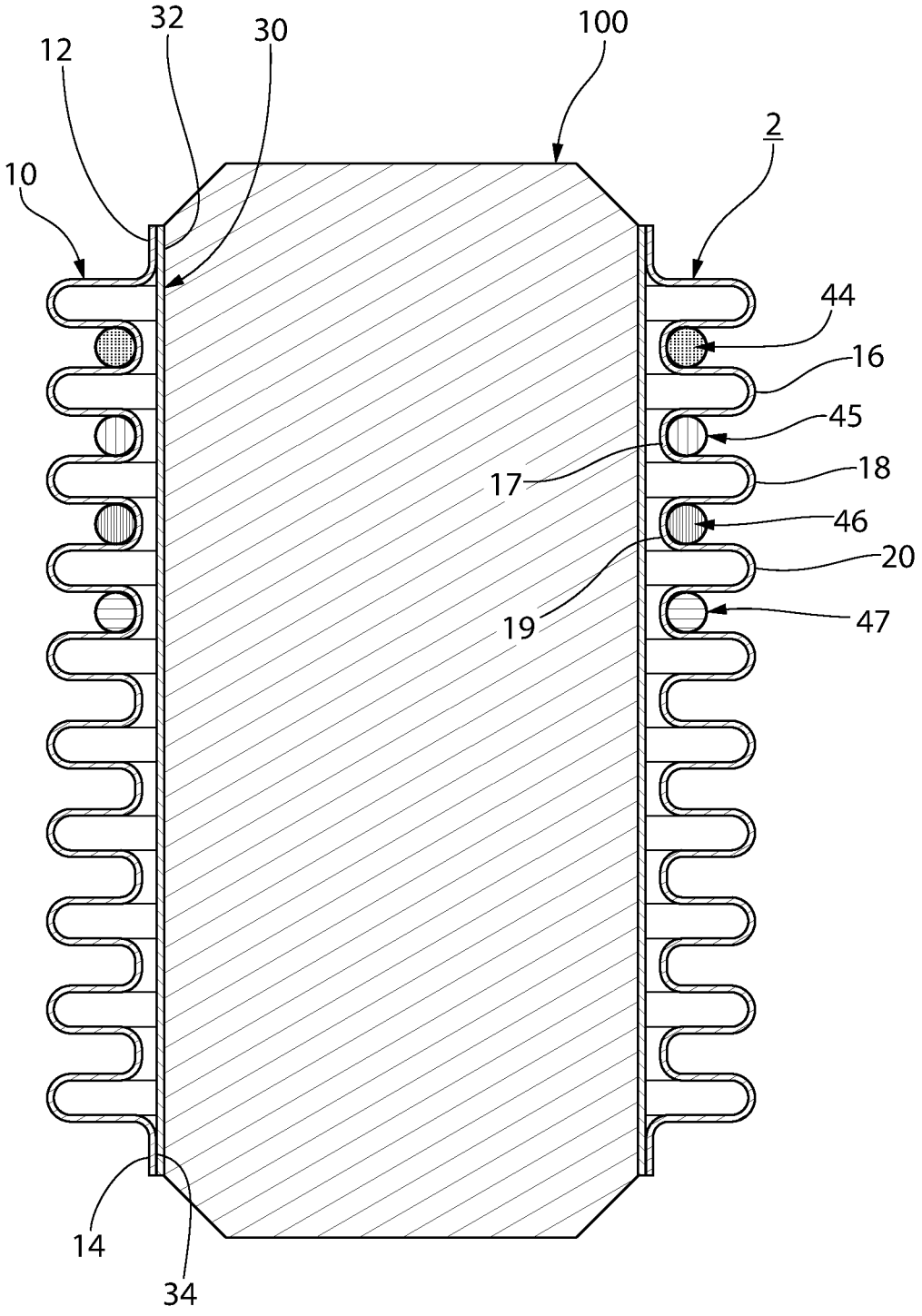
FIG. 19 is a section view of the sleeve member of FIG. 5, shown with the beverage can, and also shown with the sleeve member including a number of band members.

FIG. 19 shows a section view of the sleeve member 2 with the beverage can 100. As shown, the sleeve member 2 may optionally further include a number of band members 44,45, 46,47 each being located on and concentric with a corresponding one of the recessed portions (only two of the recessed portions 17,19 are numbered). The band members 44,45,46,47 are preferably made of an elastomeric material, and are biased toward engagement with the recessed portions 17,19. Accordingly, the novel geometry of the sleeve member 2 (i.e., by virtue of the bellows member 10) advantageously allows for a mechanism by which users can self-identify with the sleeve member 2. That is, users, such as children, can couple the band members 44,45,46,47, which may be any different color, to the recessed portions 17,19, thereby providing for a more intimate connection with the sleeve member 2.

Figure 20:
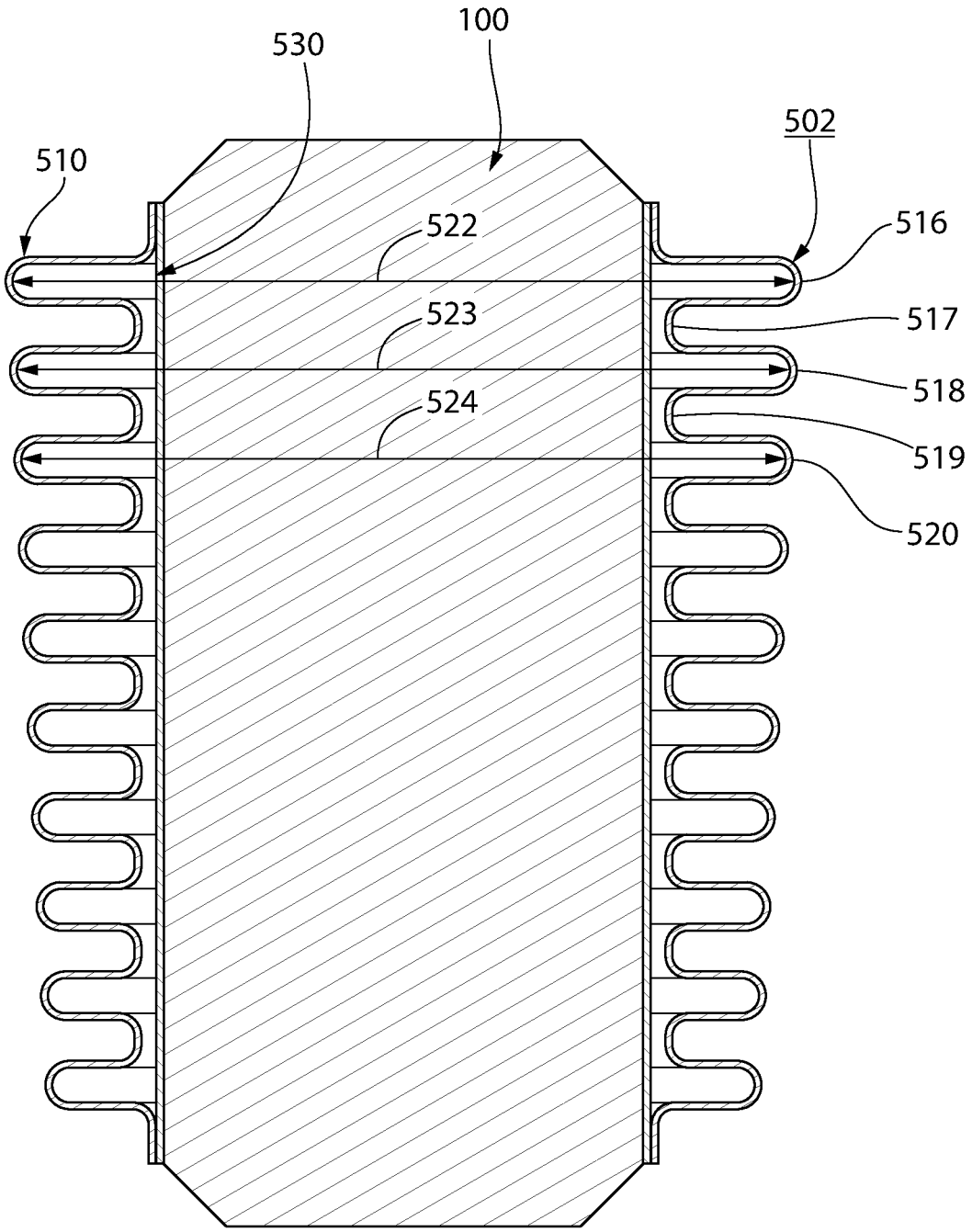
FIG. 20 is a section view of another sleeve member, shown with the beverage can, in accordance with another non-limiting embodiment of the disclosed concept.

FIG. 20 shows a section view of another sleeve member 502, shown with the beverage can 100, in accordance with another non-limiting embodiment of the disclosed concept. The sleeve member 502 is structured substantially the same as the sleeve member 2, discussed above. As such, for purposes of economy of disclosure, only significant differences will be discussed in detail. As shown, the sleeve member 502 includes a bellows member 510 and an inner liner 530 connected to the bellows member 510. The bellows member 510 has a number of peaks 516,518,520 and a number of recessed portions 517,519 each extending between a corresponding two of the peaks 516,518,520. The peaks 516,518,520 each have a corresponding diameter 522,523,524. The diameter 522 of the first peak 516 is greater than the diameter 523 of the second peak 518, and the diameter 523 of the second peak is greater than the diameter 524 of the third peak 520. Accordingly, the sleeve member 502 provides for a unique/novel tapered geometry, allowing users to further self-identify with their product, while still providing for the same advantages discussed above in association with the sleeve member 2.

It is also within the scope of the disclosed concept for a container assembly kit (not shown) to include the sleeve member 502, and also include a novel shell member similar to the shell members 202,350, discussed above, but corresponding to the shape/geometry of the sleeve member 502. That is, the shell member, which may optionally be transparent, may have a tapered tubular wall corresponding to the tapered nature of the sleeve member 502. As such, the container assembly kit provides a novel geometry, and further allows its user to self-identify with it.

Figure 21:
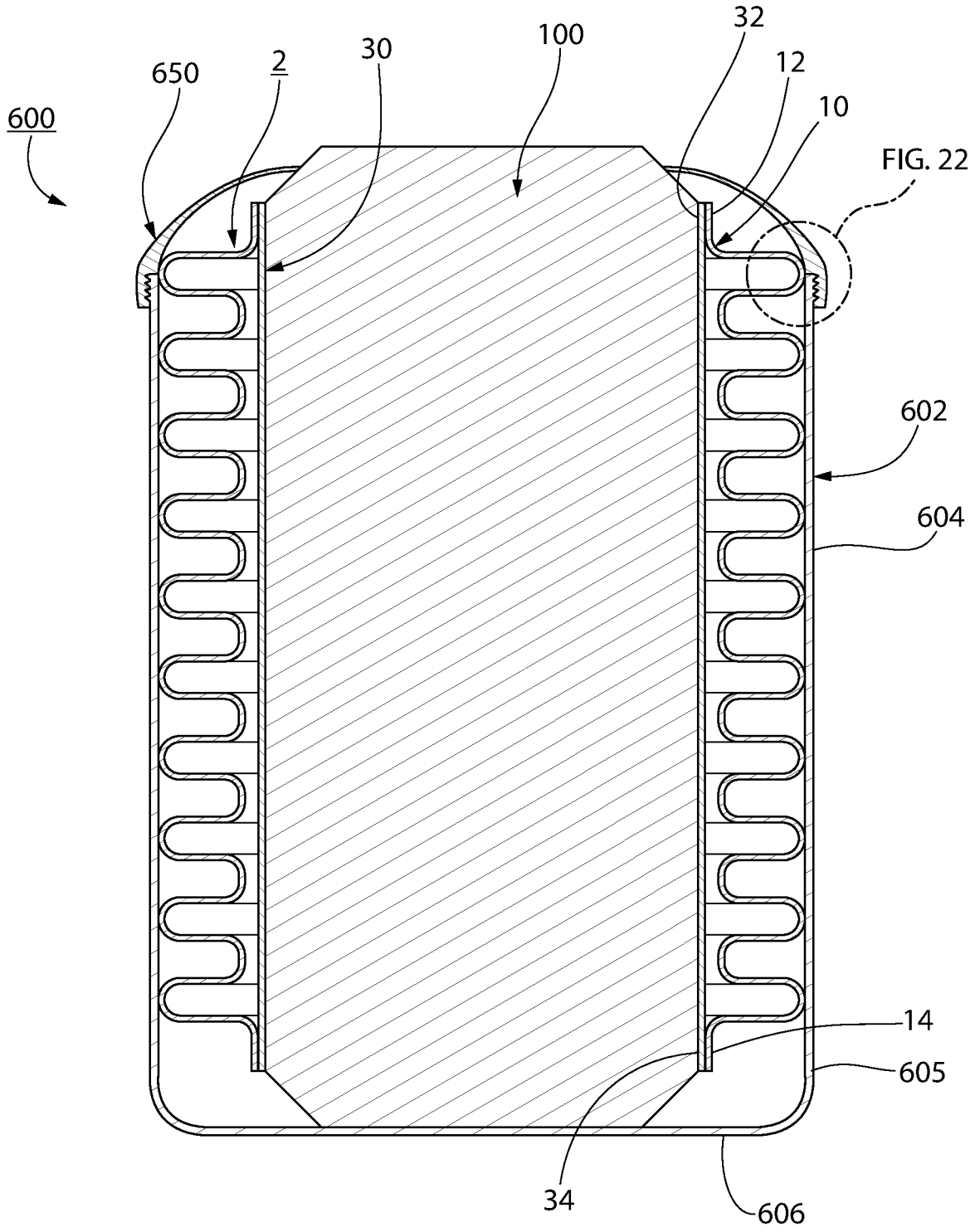
FIG. 21 is another section view of another container assembly kit, shown with the beverage can, in accordance with another non-limiting embodiment of the disclosed concept.
Figure 22:
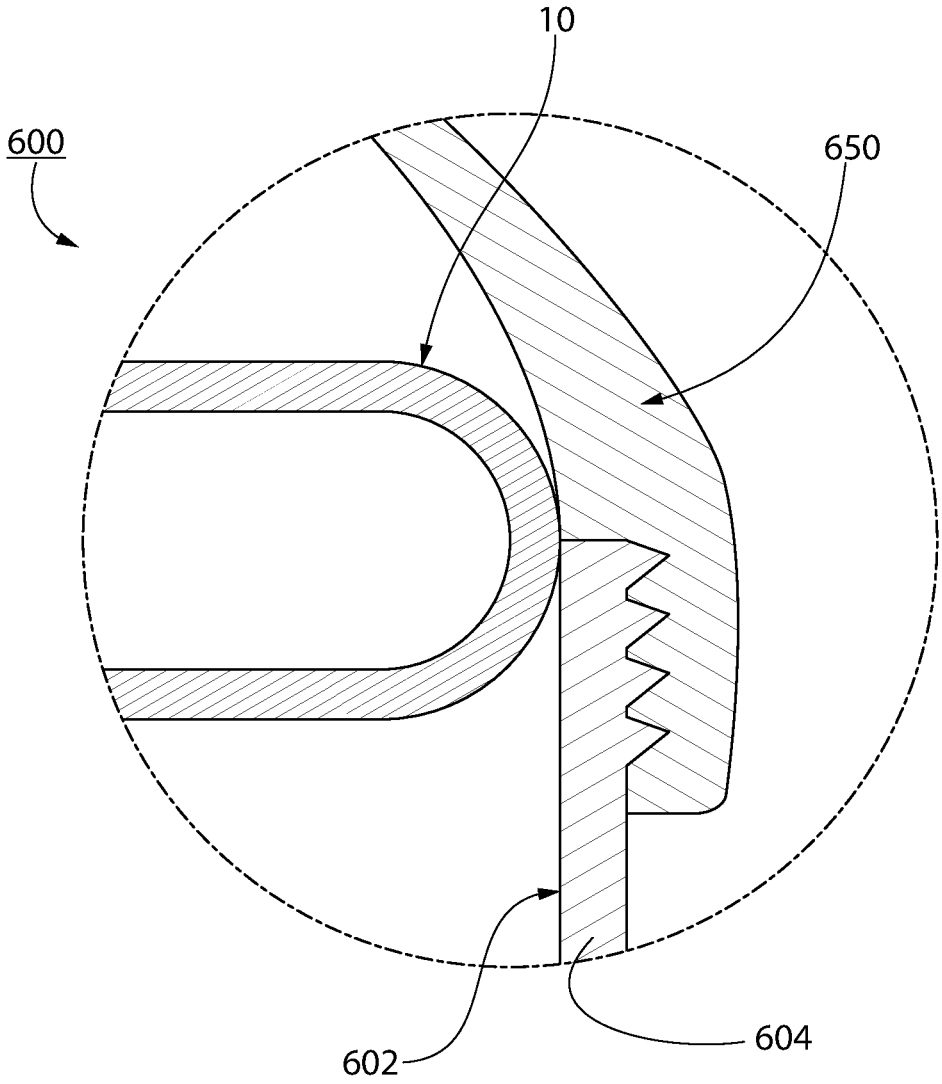
FIG. 22 is an enlarged view of a portion of the container assembly kit of FIG. 21.

FIGS. 21 and 22 depict section views of another container assembly kit 600, shown with the beverage can 100, in accordance with another non-limiting embodiment of the disclosed concept. The container assembly kit 600 is structured substantially the same as the container assembly kit 200, discussed above. As such, for purposes of economy of disclosure, only significant differences will be discussed in detail. The container assembly kit 600 includes the sleeve member 2, a shell member 602, and an annular-shaped coupling member 650. The shell member 602, which may be transparent, includes a tubular wall 604 and a base 606. The tubular wall 604 has an end 605, and the base 606 extends from the end 605. As shown in FIGS. 21 and 22, the coupling member 650 is threadably connected to the tubular wall 604 proximate the top 12 of the bellows member 10 and the top 32 of the inner liner 30. It will be appreciated that when the coupling member 650 is threaded onto the shell member 602, a force is imparted to the beverage can 100. As a result, the likelihood that the beverage can 100 will inadvertently exit the sleeve member 2 through the top of the sleeve member 2 is significantly minimized.

It will be appreciated that the bodies of the shell members 202,350 may be made of any suitable material known in the art. For example and without limitation, the bodies of the shell members 202,350 may be made of a suitable ultraviolet resistant plastic material (e.g., Polytetrafluoroethylene (PTFE), Polyvinylidene fluoride (PVDF), and/or plastics blended with ultraviolet stabilizers).

Figure 23:
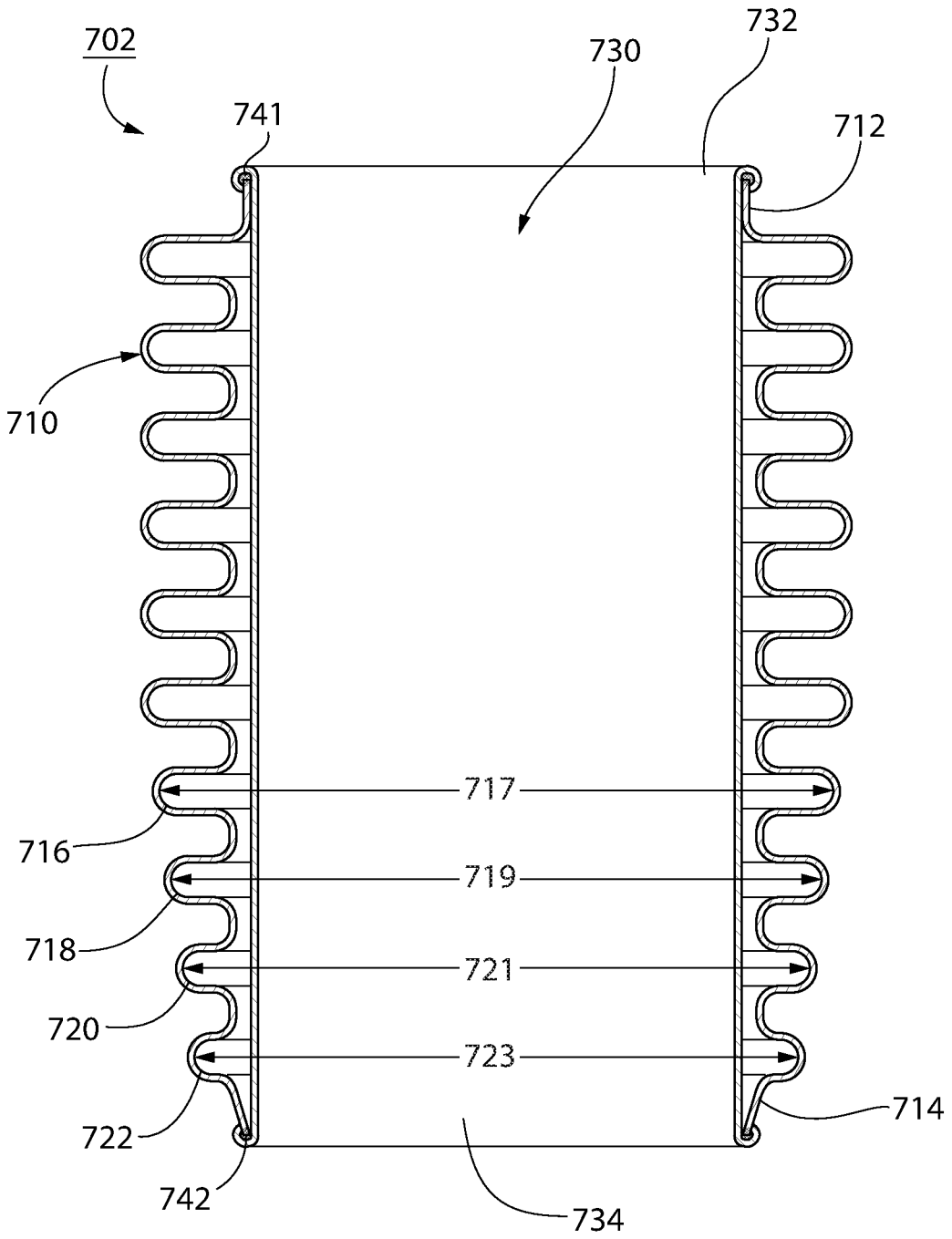
FIG. 23 is a section view of another sleeve member, in accordance with another non-limiting embodiment of the disclosed concept.

FIG. 23 is a section view of another sleeve member 702, in accordance with another non-limiting embodiment of the disclosed concept. The sleeve member 702 includes an exterior member in the form of a bellows member 710, and an inner liner 730 located internal with respect to the bellows member 710. It will be appreciated that the bellows member 710 and the inner liner 730 are structured and configured similar to the bellows member 10 and inner liner 30 of the sleeve member 2, discussed above. As such, like numbers will be used to described like features. Accordingly, the top 732 and the bottom 734 of the inner liner 730 are connected to the top 712 and the bottom 714 of the bellows member 710, respectively, such that a vacuum entrapment is provided between bellows member 710 and the inner liner 730. However, in accordance with the disclosed concept, the top 732 and bottom 734 of the inner liner 730 are secured to the top 712 and bottom 714 of the bellows member 710, respectively, via a respective first brazing material 741 and a respective second brazing material 742 in order to provide for the vacuum entrapment. As such, advantages associated with the sleeve member 2 are likewise associated with the sleeve member 702.

Furthermore, as shown in FIG. 23, the top 732 and the bottom 734 of the inner liner 730 each have a corresponding annular-shaped curl extending over and around a respective one of the top 712 and the bottom 714 of the bellows member 710. It will be appreciated that such structure provides users with a relatively smooth surface to engage during use. Continuing to refer to FIG. 23, the bellows member 710 is provided with a tapered region to facilitate gripping in cup-holders (e.g., cup-holders in automobiles). More specifically, as shown, the bellows member 710 has a plurality of peaks 716,718,720,722 each having a corresponding diameter 717,719,721,723. The diameter 717 is greater than the diameter 719, which is greater than the diameter 721, which is greater than the diameter 723. As shown, the peak 722 is located at or about the bottom 714 of the bellows member 710. It will be appreciated that this narrowing and tapered structure allows the sleeve member 702 to be more easily received in cup-holders. Specifically, the peaks 720,722, being relatively narrow in terms of diameter, can easily rest in the cup-holder, while the peaks 716,718, being relatively wide in terms of diameter, can be pressed into the walls of the cup-holder, thus being maintained therein via a strong friction fit, one that might not otherwise be achievable with a sleeve member having a constant external diameter.

Figure 24:
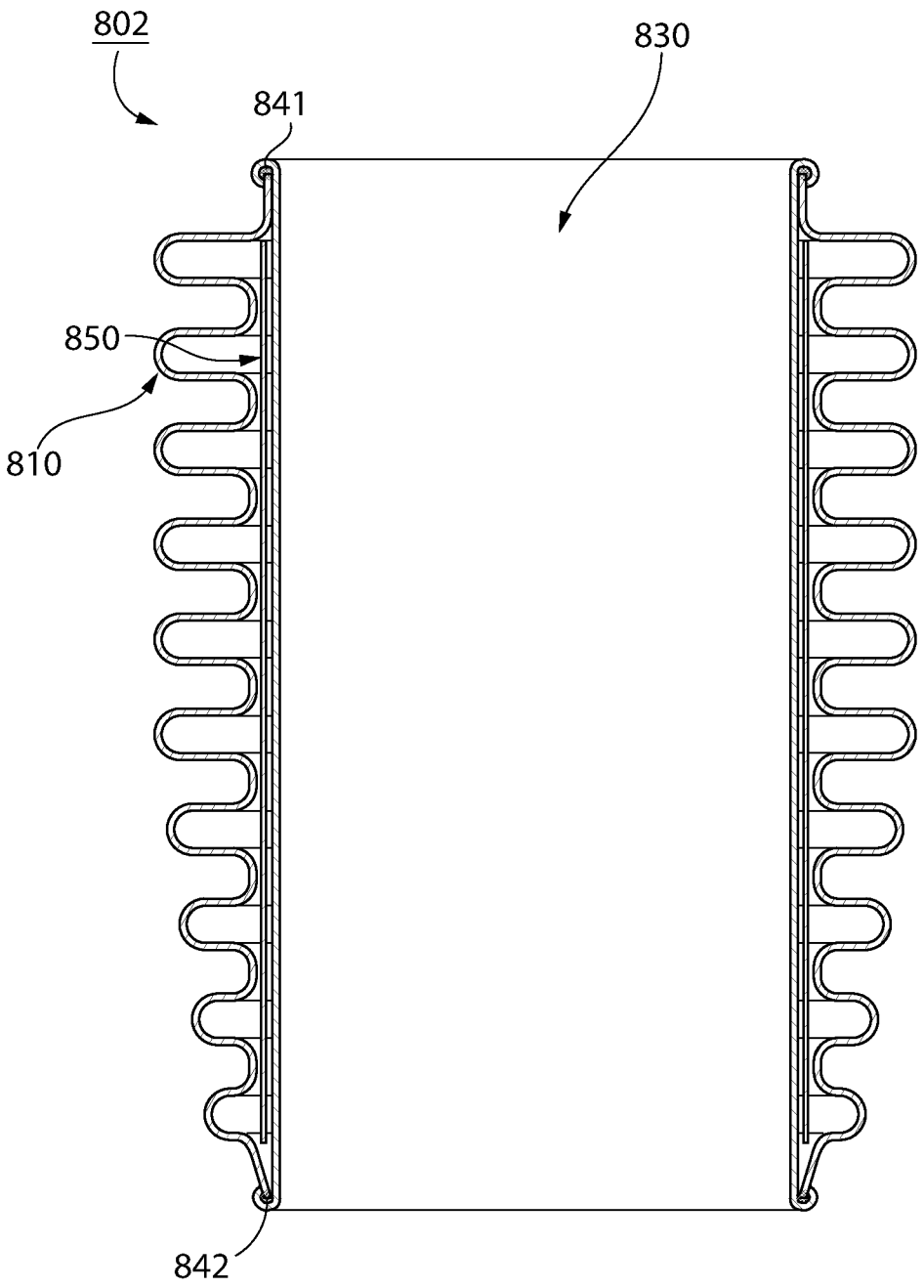
FIG. 24 is a section view of another sleeve member, in accordance with another non-limiting embodiment of the disclosed concept.

FIG. 24 is a section view of another sleeve member 802, in accordance with another non-limiting embodiment of the disclosed concept. The sleeve member 802 includes an exterior member in the form of a bellows member 810, and an inner liner 830 located internal with respect to the bellows member 810. It will be appreciated that the bellows member 810 and the inner liner 830 are structured and configured similar to the bellows member 710 and inner liner 730 of the sleeve member 702, discussed above. As such, like numbers will be used to described like features. Accordingly, the top and the bottom of the inner liner 830 are connected to the top and the bottom of the bellows member 810, respectively, such that a vacuum entrapment is provided between bellows member 810 and the inner liner 830. In accordance with the disclosed concept, the top and bottom of the inner liner 830 are secured to the top and bottom of the bellows member 810, respectively, via a respective first brazing material 841 and a respective second brazing material 842 in order to provide for the vacuum entrapment. As such, advantages associated with the sleeve members 2,702 are likewise associated with the sleeve member 802. Additionally, the sleeve member 802 further includes a tubular-shaped radiant shield 850 located between the bellows member 810 and the inner liner 830. The radiant shield 850 is encapsulated between the bellows member 810 and the inner liner 830, is movably disposed between the bellows member 810 and the inner liner 830, and extends from proximate the top of the bellows member 810 and the inner liner 830 to the bottom of the bellows member 810 and the inner liner 830. In one example embodiment, the radiant shield 850 is made of 316L stainless steel, and functions to provide an additional insulative barrier between the interior of the inner liner 830 and the exterior of the bellows member 810, thus providing for a relatively superior insulating product.

Figure 25:
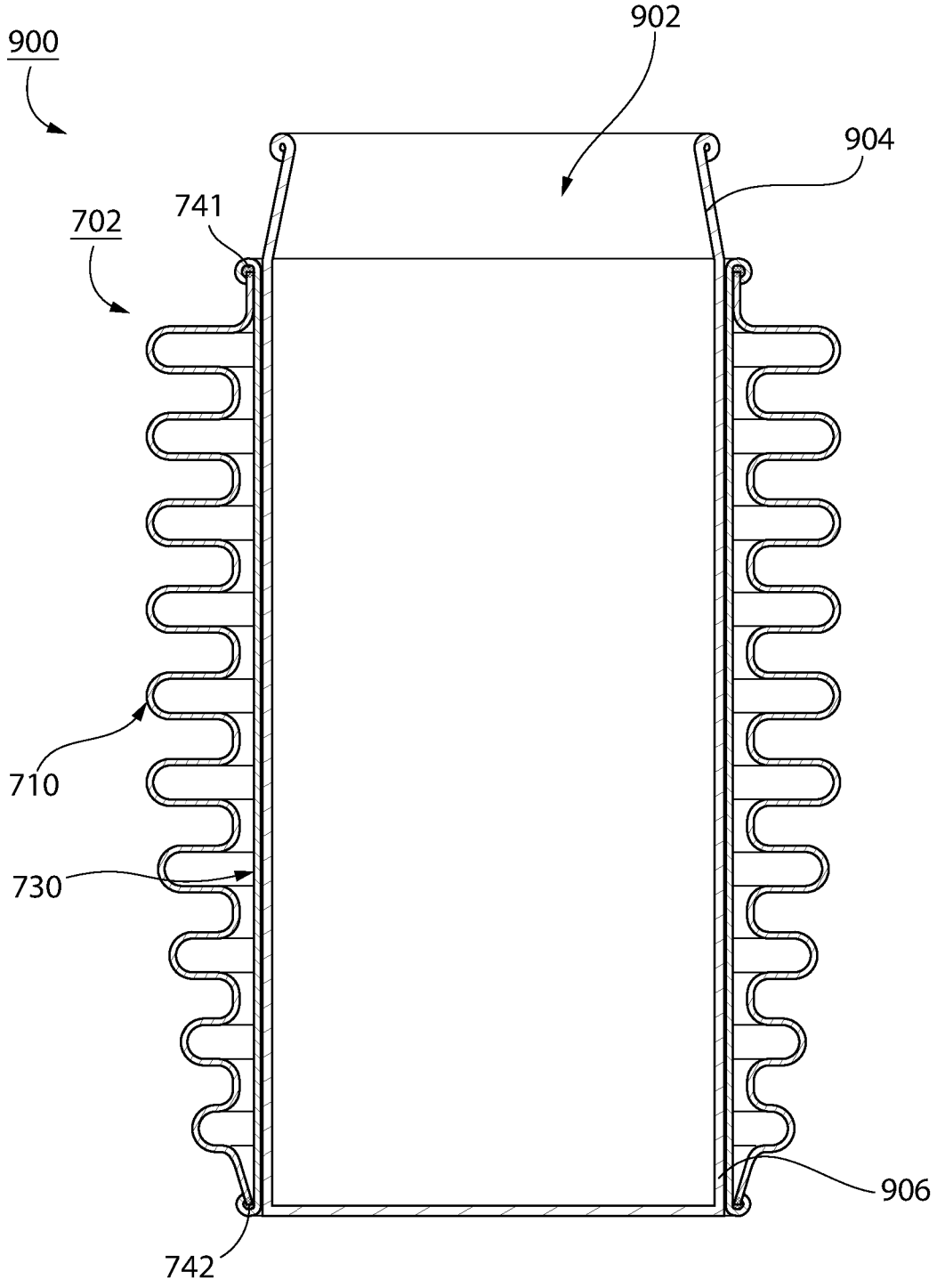
FIG. 25 is a section view of another container assembly kit, in accordance with another non-limiting embodiment of the disclosed concept.

FIG. 25 shows a container assembly kit 900, in accordance with one non-limiting embodiment of the disclosed concept. The container assembly kit 900 includes the sleeve member 702, and a cup 902 located internal with respect to the sleeve member 702. As shown, a top of the cup 902 extends upwardly and radially inwardly with respect to a central axis of the sleeve member 702.

Figure 26:
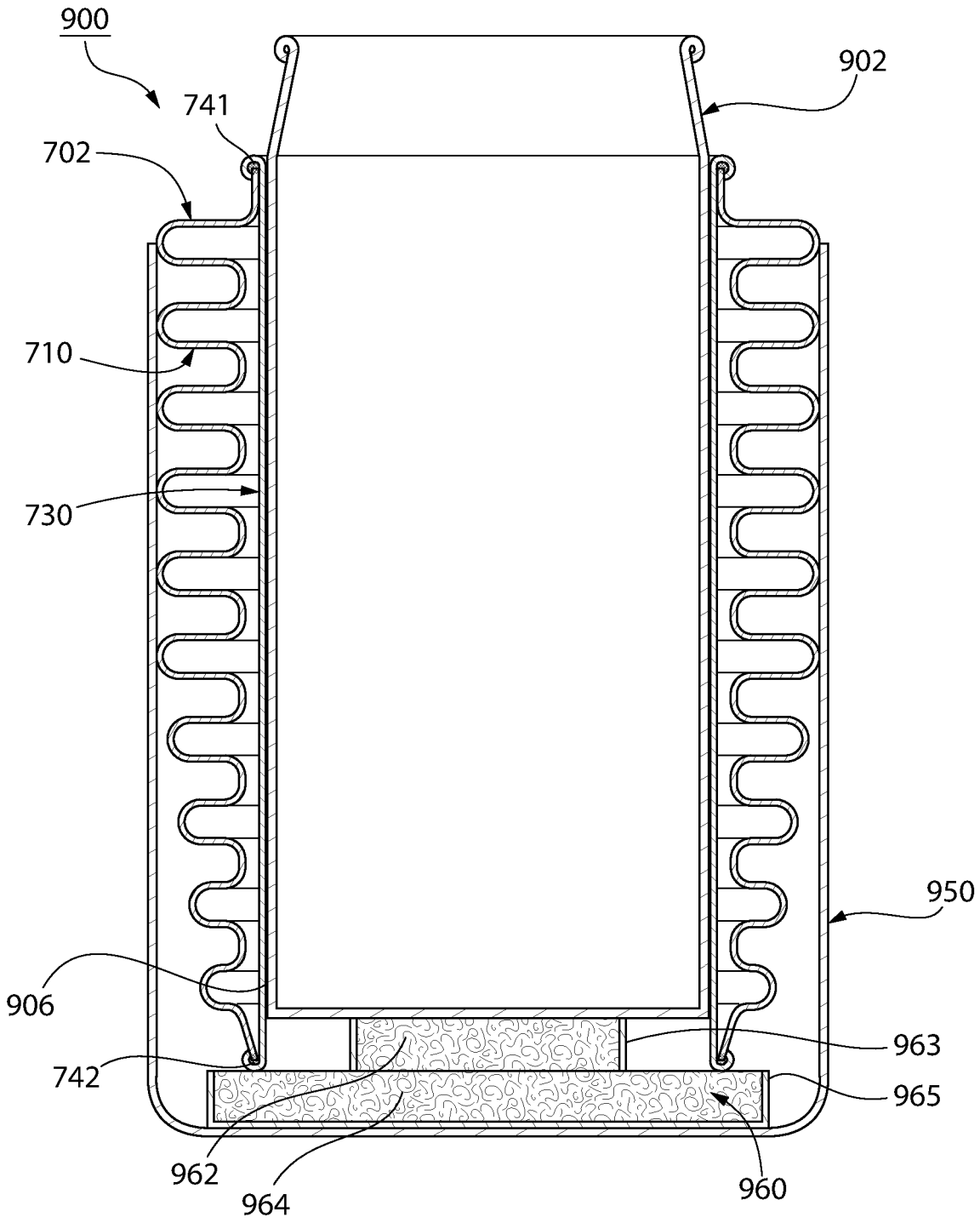
FIG. 26 is a section view of the container assembly kit of FIG. 25, shown as employed with a shell member.
Figure 26A:
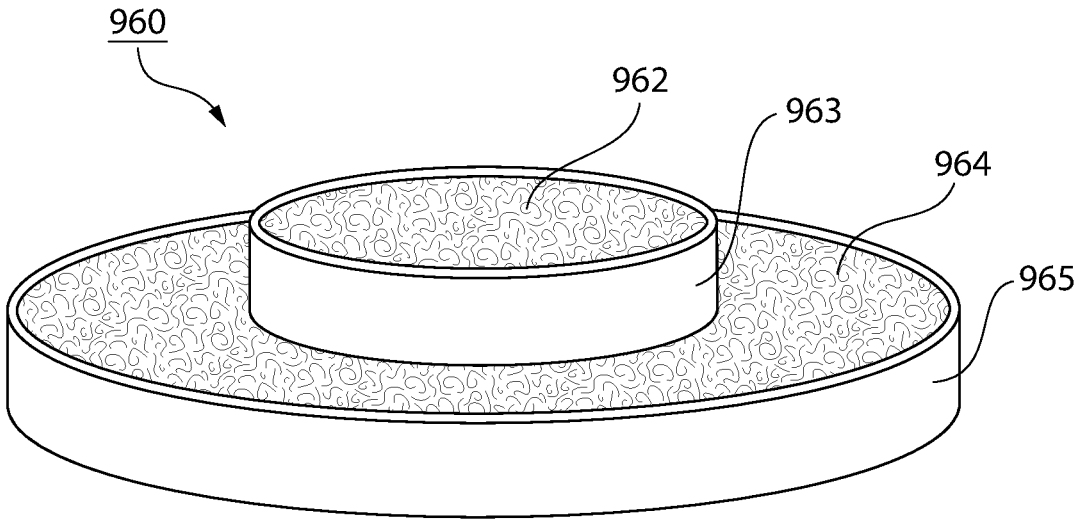
FIG. 26A is an isometric view of a pad member for the container assembly kit of FIG. 26.

FIG. 26 shows the container assembly kit 900 with a shell member 950 and an insulative member 960 coupled to the shell member. FIG. 26A shows an isometric view of the insulative member 960. As shown in FIG. 26A, the insulative member 960 includes a first base member (e.g., without limitation, neoprene member 962) and a second base member (e.g., without limitation, neoprene member 964) coupled to the first neoprene member 962. The first and second neoprene members 962,964 each have a corresponding wicking layer (e.g., without limitation, silicone layer 963, 965) bonded to a perimeter of the neoprene members 962,964. By incorporating the silicone layers 963,965 with the insulative member 960, moisture is advantageously able to be wicked away from the neoprene members 962,964. It will thus be appreciated that the silicone layers 963,965 are not structured to engage the cup 902 or the sleeve member 702.

Figure 27A:
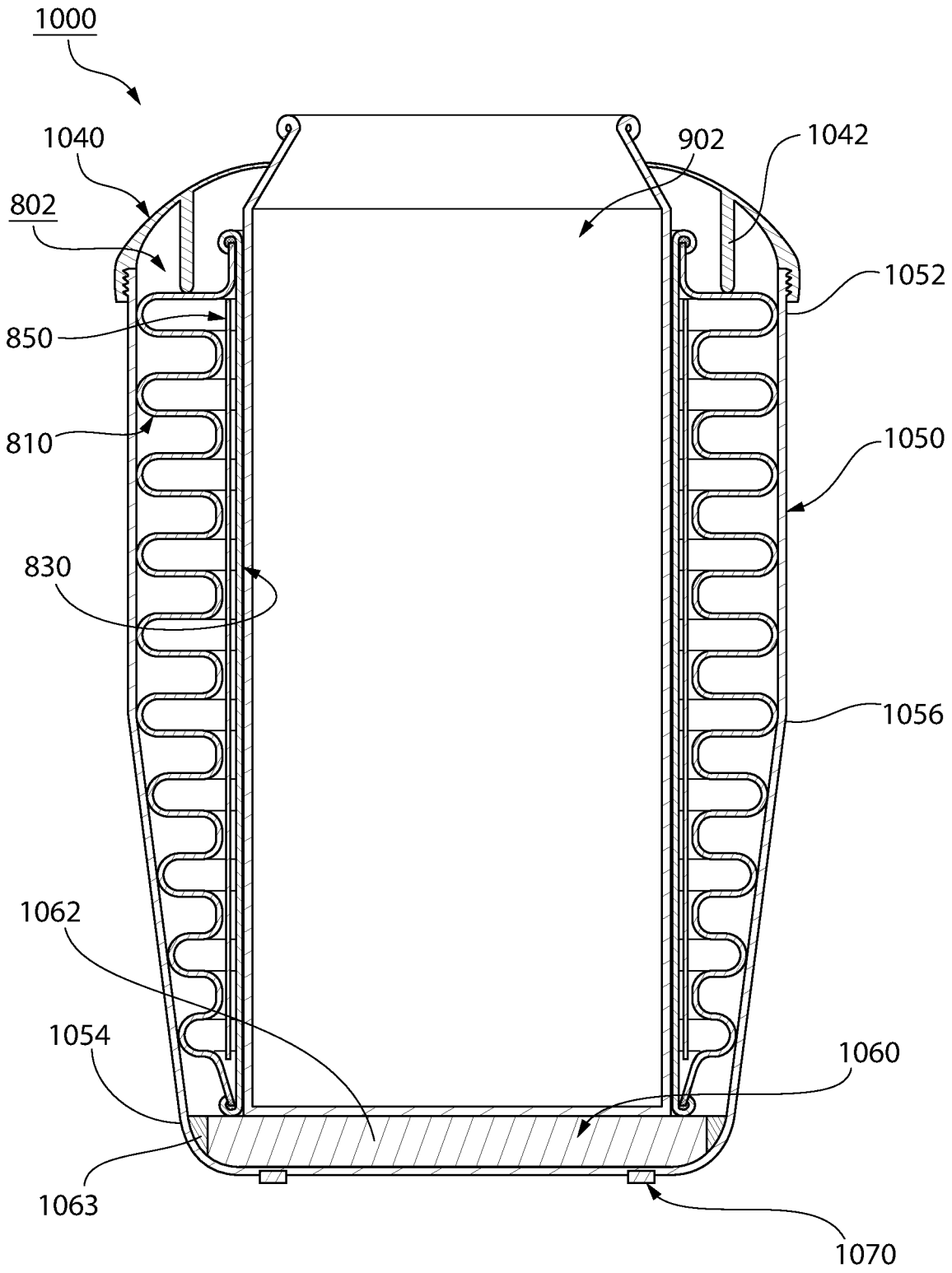
FIG. 27A is a section view of another container assembly kit, shown as employed with a cup, in accordance with another non-limiting embodiment of the disclosed concept.
Figure 27B:
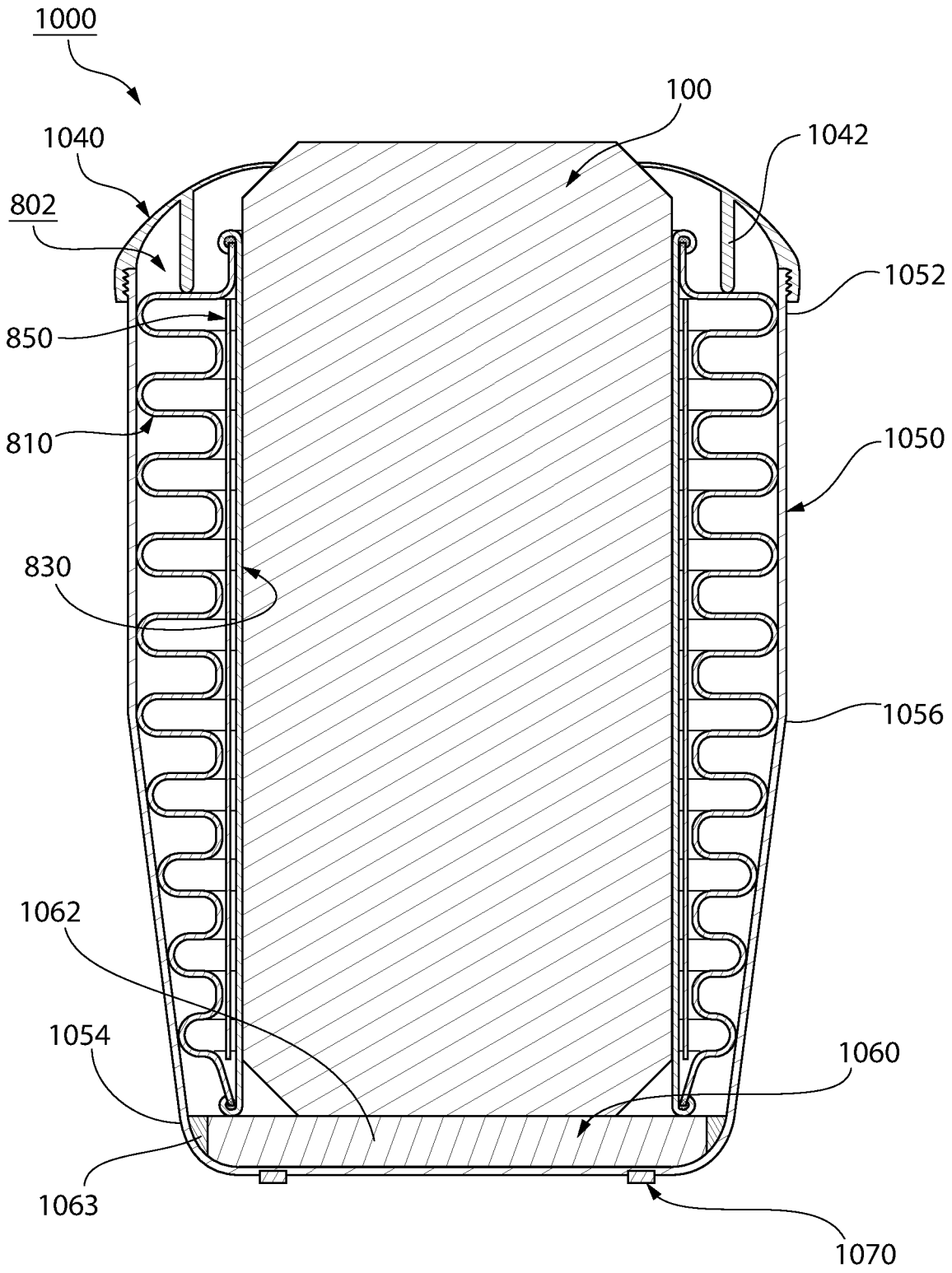
FIG. 27B is a section view of the container assembly kit of FIG. 27A, shown as employed with a can, in accordance with another non-limiting embodiment of the disclosed concept.
Figure 28:
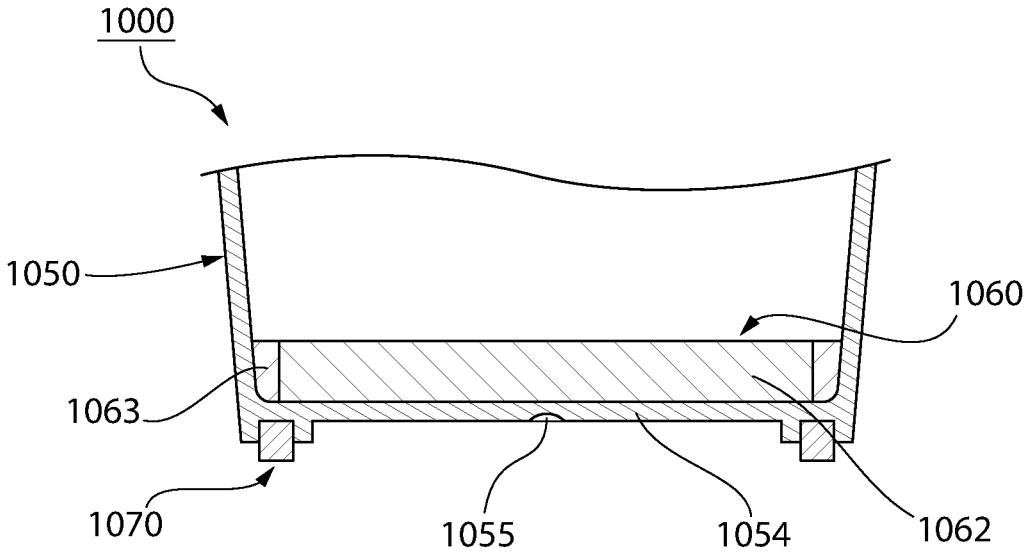
FIG. 28 is another section view of a portion of the container assembly kit of FIGS. 27A and 27B, shown without the sleeve member and the can.

FIGS. 27A, 27B, and 28 are different section views of another container assembly kit 1000, FIG. 27A being shown as employed with the cup 902, and FIG. 27B being shown as employed with the can 100, in accordance with another non-limiting embodiment of the disclosed concept. As shown in FIGS. 27A and 27B, the container assembly kit 1000 includes the sleeve member 802, an annular-shaped coupling member 1040, a shell member 1050 coupled to the coupling member 1040, and an insulative member 1060 coupled to the shell member 1050. The coupling member 1040 has an inwardly extending flange portion 1042 engaging the bellows member 810 in order to maintain the sleeve member 802 in the container assembly kit 1000. The shell member 1050 includes a top 1052, a base 1054, and a middle region 1056 located between the top 1052 and the base 1054. As shown, the shell member 1050 narrows, or tapers, from the middle region 1056 to the base 1054. In this manner, the sleeve member 802 is advantageously able to be well maintained in the shell member 1050. See for example, the tapered region of the bellows member 810 and its close fitting relationship with the tapered portion of the shell member 1050. Additionally, it will be appreciated that the base 1054 of the shell member 1050 further has an annular-shaped grooved region, and the container assembly kit 1000 further has an O-ring 1070 having a rectangular-shaped cross section press-fit into the grooved region of the base 1054 of the shell member 1050. The O-ring 1070 is partially located in the grooved region in order to be retained therein, and partially located external with respect to the grooved region to provide beneficial friction when a user places the container assembly kit 1000 onto a surface (e.g., the container assembly kit 1000 will be less likely to slide due to the O-ring 1070).

FIG. 28 shows another section view of a portion of the container assembly kit 1000, without the sleeve member 802 and the can 100. As shown, the base 1054 of the shell member 1050 further has a recessed portion 1055. It will be appreciated that the recessed portion 1055 coincides with the grooved region in which the O-ring 1070 rests in order to provide access thereto. The recessed portion 1055 thus provides a region in which a user can insert a finger and readily remove the O-ring 1070 when desired. Furthermore, although only one recessed portion 1055 is shown in FIG. 28, the disclosed concept contemplates that any suitable alternative number of recessed portions may be provided on the base 1054.

Figure 29:
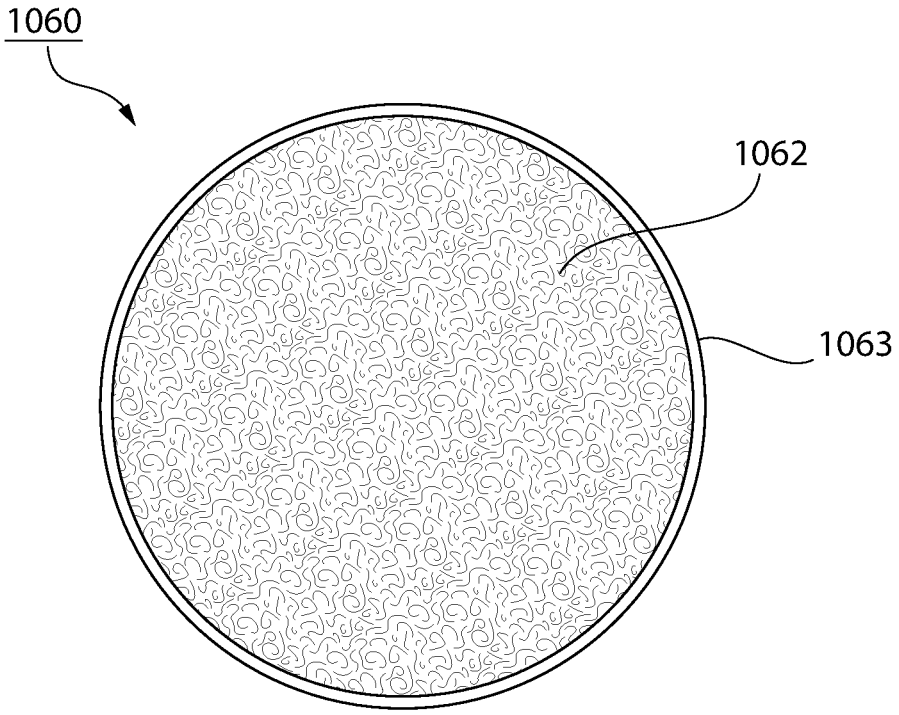
FIG. 29 is a top view of a pad member for the container assembly kit of FIGS. 27 and 28.

FIG. 29 shows a top view of the insulative member 1060. As shown, the insulative member 1060 has a base member (e.g., without limitation, neoprene member 1062) and a wicking layer (e.g., without limitation, silicone layer 1063) bonded to a perimeter of the neoprene member 1062. It will be appreciated that the insulative member 1062 thus functions similar to the insulative member 960, discussed above.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof. Furthermore, while weep holes 36,70 and sealing materials 41,81 have only been illustrated in certain of the figures, it will be appreciated that these figures are exemplary, and that although not illustrated, the sleeve members in each of the other figures likewise have a weep hole and a corresponding sealing material sealing the weep hole.

What is claimed is:

1. A container assembly kit comprises:

a sleeve member comprising:

a bellows member having a top and a bottom disposed opposite the top, and an inner liner disposed internal with respect to said bellows member, said inner liner having a top and a bottom disposed opposite the top of said inner liner, wherein the top and the bottom of said inner liner are connected to the top and the bottom of said bellows member, respectively, such that a vacuum entrapment is provided between said bellows member and said inner liner, and wherein a passage is provided through the top and the bottom of said bellows member, and through the top and the bottom of said inner liner; and a shell member comprising a body having a tubular wall and a base, said tubular wall having an end structured to be disposed proximate the bottom of said bellows member and the bottom of said inner liner, said base extending across the end of said tubular wall, said tubular wall extending from said base and being structured to be proximate the top of said bellows member and the top of said inner liner, said tubular wall being structured to be concentric with said inner liner and external with respect to said bellows member.

2. The container assembly kit of claim 1 wherein said shell member further has a top and a middle region disposed between the top and said base; and wherein said shell member tapers from the middle region to said base.

3. The container assembly kit of claim 1 wherein said body is substantially transparent.

4. The container assembly kit of claim 1 wherein said shell member further comprises an insulative member affixed to said base; and wherein said insulative member engages said sleeve member.

5. The container assembly kit of claim 4 wherein said insulative member is a foam member.

6. The container assembly kit of claim 4 wherein said insulative member comprises at least one base member and at least one wicking layer bonded to said at least one base member.

7. The container assembly kit of claim 6 wherein said at least one base member is at least one neoprene member; and wherein said at least one wicking layer is at least one silicone layer.

8. The container assembly kit of claim 1 further comprising an annular-shaped coupling member threadably connected to said tubular wall proximate the top of said bellows member and the top of said inner liner.

9. The container assembly kit of claim 8 wherein said coupling member has an inwardly extending flange portion engaging said bellows member in order to maintain said sleeve member in said container assembly kit.

10. The container assembly kit of claim 1 wherein said base has an annular-shaped grooved region; and wherein said container assembly kit further comprises an O-ring partially disposed in said grooved region in order to be retained therein, and partially disposed external with respect to said grooved region.

11. The container assembly kit of claim 10 wherein said O-ring has a generally rectangular-shaped cross section.

12. The container assembly kit of claim 11 wherein said base further has a number of recessed portions coinciding with said grooved region in order to provide access thereto.

13. A container assembly kit comprises:

a sleeve member comprising:

an exterior member having a top and a bottom disposed opposite the top, and an inner liner disposed internal with respect to said exterior member, said inner liner having a top and a bottom disposed opposite the top of said inner liner, wherein the top and the bottom of said inner liner are connected to the top and the bottom of said exterior member, respectively, such that a vacuum entrapment is provided between said exterior member and said inner liner, and wherein a passage is provided through the top and the bottom of said exterior member, and through the top and the bottom of said inner liner; and a cup structured to be coupled to said sleeve member, said cup having an open top, a closed bottom, and a tubular wall extending therebetween, the tubular wall being structured to be disposed internal with respect to said sleeve member.

14. The container assembly kit of claim 13 wherein said exterior member is a bellows member.

15. The container assembly kit of claim 14 wherein the top of said cup has a curl; and wherein said curl engages at least one of the top of said bellows member and the top of said inner liner in order to maintain said cup on said sleeve member.

16. The container assembly kit of claim 15 further comprising an annular-shaped gasket member coupled to said cup proximate said curl; and wherein said gasket member is structured to be disposed between the top of said inner liner and the top of said cup in order to maintain said cup on said sleeve member.

17. The container assembly kit of claim 16 wherein the top of said cup has an annular-shaped grooved region; and wherein said gasket member is coupled to said grooved region.

18. The container assembly kit of claim 14 further comprising a shell member comprising a body having a tubular wall and a base; wherein said tubular wall of said shell member has an end disposed proximate the bottom of said bellows member and the bottom of said inner liner; wherein said base extends across the end of said tubular wall of said shell member; wherein said tubular wall of said shell member extends from said base to proximate the top of said bellows member and the top of said inner liner; and wherein said tubular wall of said shell member is concentric with said inner liner and external with respect to said bellows member.

19. The container assembly kit of claim 18 wherein said shell member further comprises an insulative member affixed to said base; and wherein said insulative member engages said sleeve member and the bottom of said cup.

20. The container assembly kit of claim 19 wherein said insulative member comprises a first base member, a second base member coupled to said first base member, a first wicking layer bonded to said first base member, and a second wicking layer bonded to said second base member.

21. The container assembly kit of claim 20 wherein said first and second base members are first and second neoprene members, respectively; and wherein said first and second wicking layers are first and second silicone layers, respectively.

22. The container assembly kit of claim 18 further comprising an annular-shaped coupling member threadably connected to said tubular wall of said shell member proximate the top of said bellows member and the top of said inner liner.

23. The container assembly kit of claim 13 wherein the top of said cup extends upwardly and radially inwardly.

* * * * *